US006952887B2

(12) United States Patent
Muchnik

(10) Patent No.: US 6,952,887 B2
(45) Date of Patent: Oct. 11, 2005

(54) MARKING DEVICE AND METHOD FOR INDICATING LOCATIONS ON A SUPPORT STRUCTURE FOR FASTENER PLACEMENT AND MEASUREMENT

(76) Inventor: Boris A. Muchnik, 12303 Braxfield Ct. #12, Rockville, MD (US) 20852

( * ) Notice: Subject to any disclaimer, the term of this patent is extended or adjusted under 35 U.S.C. 154(b) by 0 days.

(21) Appl. No.: 10/428,008

(22) Filed: May 2, 2003

(65) Prior Publication Data

US 2004/0216319 A1 Nov. 4, 2004

(51) Int. Cl.[7] ..... B25H 7/00

(52) U.S. Cl. ..... 33/666; 33/613; 33/645; 33/669

(58) Field of Search ..... 33/613, 645, 666, 33/667, 669, 755, 759, 760, 761, 668; 101/19, 28, 29, 30

(56) References Cited

U.S. PATENT DOCUMENTS 564,342 A 7/1896 Sherman
776,897 A 12/1904 Ferris
833,168 A 10/1906 Keller
1,470,470 A 10/1923 Pas
1,936,783 A * 11/1933 Chase ..... 101/30
2,428,213 A * 9/1947 Gloede ..... 33/666
2,675,624 A 4/1954 Rayl, Sr.

(Continued)

*Primary Examiner*—G. Bradley Bennett
*Assistant Examiner*—Travis Reis
(74) *Attorney, Agent, or Firm*—Berenato, White & Stavish, LLC

(57) ABSTRACT

A marking device of the present invention includes a resilient member to shield a marking member and enable an article with the device to traverse a surface without leaving a mark. The marking member is fixed to the device base and may have an adjustable height. The device may further include an indicator to provide a visual, audible or other type of signal indicating successful completion of marking. Further, the marking device may be slidably attached to measurement instruments to mark locations corresponding to desired measurements. In operation, the article or instrument with marking devices secured thereto is positioned at a desired location relative to the surface. Pressure is applied to the article or instrument, where marking members of the devices protrude through corresponding resilient members to produce marks on the surface. A level device with an adhesive base may be removably secured to an article for proper article orientation.

20 Claims, 15 Drawing Sheets

U.S. PATENT DOCUMENTS

| | | | | | |
|---|---|---|---|---|---|
| 2,741,025 | A | | 4/1956 | Stewart | |
| 4,041,649 | A | * | 8/1977 | Stewart | 33/645 |
| 4,208,802 | A | | 6/1980 | Berndt | |
| 4,382,337 | A | | 5/1983 | Bendick | |
| 4,455,756 | A | * | 6/1984 | Greene | 33/613 |
| 4,473,957 | A | | 10/1984 | Faulkner | |
| 4,512,084 | A | | 4/1985 | Lieberman | |
| 4,527,338 | A | | 7/1985 | Dickinson et al. | |
| 4,837,942 | A | | 6/1989 | Watts | |
| 4,893,776 | A | | 1/1990 | Floyd | |
| 4,903,934 | A | | 2/1990 | Fremstad | |
| 4,944,094 | A | | 7/1990 | Depiano et al. | |
| 4,993,168 | A | * | 2/1991 | Acuna | 33/666 |
| D315,316 | S | | 3/1991 | Reynolds et al. | |
| 5,129,154 | A | | 7/1992 | Aydelott | |
| 5,180,135 | A | | 1/1993 | Hindall | |
| 5,398,906 | A | | 3/1995 | Aydelott | |
| 5,435,074 | A | | 7/1995 | Holevas et al. | |
| 5,477,620 | A | | 12/1995 | Barnett | |
| 5,802,729 | A | | 9/1998 | O'Brien et al. | |
| 5,829,152 | A | * | 11/1998 | Potter et al. | 33/668 |
| 5,867,917 | A | | 2/1999 | Karon | |
| 6,000,142 | A | | 12/1999 | Deaton | |
| 6,026,584 | A | * | 2/2000 | Wegman | 33/613 |
| 6,029,362 | A | | 2/2000 | Miodragovic | |
| 6,178,655 | B1 | | 1/2001 | Potter et al. | |
| 6,185,831 | B1 | | 2/2001 | Pluciennik | |
| 6,205,669 | B1 | * | 3/2001 | Sollars et al. | 33/371 |
| 6,279,257 | B1 | | 8/2001 | Lemire | |
| 6,405,446 | B1 | | 6/2002 | Monroe | |
| 6,412,384 | B1 | | 7/2002 | Iwao | |
| 6,418,631 | B1 | | 7/2002 | Ramsthaler | |
| 6,421,928 | B1 | | 7/2002 | Miller | |
| 2002/0066199 | A1 | * | 6/2002 | Hanson | 33/613 |
| 2002/0066200 | A1 | * | 6/2002 | Lombardo | 33/666 |
| 2002/0078582 | A1 | * | 6/2002 | Krake et al. | 33/613 |
| 2002/0095812 | A1 | * | 7/2002 | Newman | 33/613 |
| 2003/0051363 | A1 | * | 3/2003 | Hofmeister et al. | 33/613 |
| 2003/0229999 | A1 | * | 12/2003 | Rimback | 33/613 |

* cited by examiner

MARKING DEVICE AND METHOD FOR INDICATING LOCATIONS ON A SUPPORT STRUCTURE FOR FASTENER PLACEMENT AND MEASUREMENT

BACKGROUND OF THE INVENTION

1. Technical Field

The present invention pertains to marking and measuring devices. In particular, the present invention pertains to a marking device that indicates locations on a support surface or structure for measurement purposes or for placement of fasteners to suspend or attach an article to that surface.

2. Discussion of Related Art

Marking devices are typically utilized to identify particular locations on a surface for performance of a task. For example, these devices may identify locations on a wall or other support surface for placement of fasteners to mount an article (e.g., picture frame, mirror, cornice, board, cabinet, shelf, etc.) on that support surface.

One type of marking device disposes a marking member within a base to prevent contact with a surface during preparatory manipulations. Force is typically applied by the user directly to the proximal end of the marking device or member to urge the marking member from the base and place a mark on the surface. Examples of this type of marking device are disclosed in U.S. Pat. No. 564,342 (Sherman), U.S. Pat. No. 776,897 (Ferris), U.S. Pat. No. 4,893,776 (Floyd), U.S. Pat. No. 4,993,168 (Acuna) and U.S. Pat. No. 6,412,384 (Iwao).

Another type of marking device includes a configuration where the marking member always protrudes from a base, thereby being exposed to the surface. Force may be applied to the base outside the confines of the marking member to place a mark on the surface. Examples of this type of marking device are disclosed in U.S. Pat. No. D315,316 (Reynolds et al), U.S. Pat. No. 2,675,625 (Rayl, Sr.), U.S. Pat. No. 4,382,337 (Bendick), U.S. Pat. No. 6,185,831 (Pluciennik) and U.S. Pat. No. 6,418,631 (Ramsthaler).

The above-described marking devices suffer from several disadvantages. In particular, the recessed marking member devices are not suitable to accomplish marking for "blind spots". For example, the mounting process for an article includes identifying appropriate locations on a supporting surface for fasteners that enable the article to attain a desired orientation. However, article mounting hardware to engage the fasteners are generally placed on the back of the article and are not visible during alignment with the supporting surface. Thus, the marking device with the recessed marking member must be placed proximate the mounting hardware for alignment. If the marking device is disposed in this fashion, a user is unable to view the marking device and consequently cannot provide the required force to that device to place a mark on the surface. Further, the exposed marking member devices provide no protection from the marking member. Thus, these devices enable the marking member to damage and/or mark the supporting surface at erroneous or inappropriate locations. Moreover, the exposed marking member devices enable the marking member to contact a user, thereby providing a safety hazard for the user when the marking member is implemented by a sharp object (e.g., nail, punch, etc.).

In addition, marking with respect to blind spots becomes quite cumbersome. In particular, the mounting process for an article includes identifying appropriate locations on the supporting surface for fasteners that enable the article to attain a desired orientation. However, since article mounting hardware is generally not visible during alignment with the supporting surface as described above, the process typically requires several measurements, calculations and markings that often yield undesirable results during initial mounting attempts. Thus, the process may be repeated several times prior to attaining the desired mount.

The related art has attempted to overcome this problem by providing various devices for mounting articles to support surfaces. For example, U.S. Pat. No. 4,837,942 (Watts) discloses a device for marking the location of panels, strips or other decorative objects to the surface of an automobile or other object. The device comprises a short punch having a pointed tip extending from a short cylindrical body having an annular slot, and a mounting clip having a planar receiving slot with a wide portion corresponding to the outer diameter of the cylindrical body of the punch leading to a narrowed portion corresponding to the diameter bounded by the annular slot, whereby the punch is inserted in the wide portion of the clip and slid into the narrowed portion where it is held securely. The clips are then inserted into the decorative panel and the panel held up to the abutting surface where force is then applied, thus, marking the surface to which the panel is to be applied.

U.S. Pat. No. 5,180,135 (Hindall) discloses a picture hanger locating device that supports a picture and has an integral marker for marking the location on a wall for affixing a picture hanger subsequent to the picture being moved to a desired position on the wall.

U.S. Pat. No. 5,398,906 (Aydelott) discloses a device for marking a wall to indicate where to install a support element, such as a nail, for hanging an article, such as a picture. The device is self-supporting in relation to the article and is releasably attachable to the suspension element on the article. A preferred embodiment is attachable to a saw-tooth type bracket suspension element. A second embodiment of the wall-marking device is attachable to pictures equipped with wire or cord for hanging. A third embodiment is usable with either the saw-tooth type bracket or wire suspension elements.

U.S. Pat. No. 6,000,142 (Deaton) discloses an apparatus for locating the hanging hardware of a picture on a wall. The apparatus includes a rectangular block having an inverted 'V'-shaped slot on a rear surface thereof for receiving a mounting wire or string. The block further includes a blunt protrusion located directly below the point of the "V" for marking a wall. A 'U'-shaped member connected by a spring to the block is provided for receiving the frame top portion.

The related art suffers from several disadvantages. In particular, the related art devices are similar to the marking devices with the exposed marking member described above where the marking mechanisms remain exposed during use. This enables the devices to inadvertently mark the supporting surface at undesirable locations, or permits the sharp marking mechanisms to contact and cause possible injury to the user. Further, users typically manipulate or otherwise operate the related art devices to place a mark on a supporting surface. However, since the marking mechanisms and resulting marks are typically not visible to the user during marking, the user is not aware of an improper or incomplete mark until the devices are removed from the supporting surface. Thus, the user may be required to repeat the marking process for several iterations in order to adequately mark the appropriate location, thereby placing several undesirable marks on or damaging the surface.

OBJECTS AND SUMMARY OF THE INVENTION

Accordingly, it is an object of the present invention to mark locations on a supporting surface for measurement purposes or for placement of fasteners via a marking device that selectively exposes a marking member to the supporting surface.

It is another object of the present invention to visually or audibly notify a user that a supporting surface is adequately marked at a desired location for measurement purposes or for placement of fasteners.

Yet another object of the present invention is to mark locations on a supporting surface for placement of fasteners via an adjustable or universal marking device that may be utilized with various types of article mounting hardware.

Still another object of the present invention is to mark locations on a supporting surface for placement of fasteners via application or mounting hardware specific marking devices configured for a particular type of mounting hardware.

A further object of the present invention is to facilitate secure mounting of an article to a support surface with secure mounting hardware (e.g., locking mechanism) and general or non-secure mounting hardware already attached to the article by employing marking devices secured to the article hardware to indicate proper fastener locations on the support surface.

Yet another object of the present invention is to enable a user to simply and affordably suspend an article on a support surface via two article suspension points, thereby obviating the need for utilizing a suspension wire or cord.

Still another object of the present invention is to dispose marking devices on article mounting hardware and/or a level device on an article plane or surface prior to availability of the article to a user to enable rapid and stable mounting of the article on a support surface.

A further object of the present invention is to ensure proper orientation of an article on a supporting surface via a level device removably secured to the article via an adhesive or sticky base.

The aforesaid objects may be achieved individually and/or in combination, and it is not intended that the present invention be construed as requiring two or more of the objects to be combined unless expressly required by the claims attached hereto.

According to the present invention, a marking device allows an article equipped with the device to transfer and mark an article position or article fastening locations on a support surface or structure with enhanced accuracy. The device is secured to each article mounting hardware or mechanism and is generally not visible to the user during alignment (e.g., reside in "blind spots"). The device includes a resilient member to shield a marking member and enable an article equipped with the device be maneuvered along or over a surface without marking that surface. The resilient member includes an aperture and is fixed to a device base over the marking member. The resilient member shields the marking member from scratching and/or marking a surface during initial positioning of the article on the surface. During this positioning, the device rests freely (e.g., under its own weight) on or is dragged along the surface.

The marking member is fixed to the device base (e.g., the marking member does not change position relative to the base at the time of marking) and may have an adjustable height. The base moves along with the marking member towards a surface to be marked at the time of marking. The device may further include an indicator or flag member located on the base that provides a visual (e.g., light, etc.), audible or other type of signal indicating successful completion of marking. In addition, one or more marking devices may be slidably attached to measurement instruments (e.g., rulers, gauges, compass, etc.) to mark locations (e.g., along lines, arcs, circles, etc.) corresponding to desired measurements (e.g, marks separated by or to indicate certain distances, etc.).

During operation, the article or instrument with marking devices secured thereto is positioned at a desired location relative to the surface. Pressure is applied to the article or instrument and directed toward the surface. The base and marking member of each device start moving toward the surface overcoming the elasticity of the corresponding resilient member. The marking members of each device protrude through the aperture of the corresponding resilient member and produce a mark or imprint on the surface at a desired location.

The present invention provides several advantages. In particular, the marking device is easy to manufacture and includes no conjoining moving parts, thereby providing enhanced reliability. Several applications with articles of various weights may be accommodated by adjusting the resilient member elasticity and/or the height of the marking member. Further, the device marking member is covered by a resilient member until the time of marking, thereby protecting the surface from undesirable marks and the user from stabbing injuries. Moreover, the marking action may be achieved by applying pressure to an article or marking device toward a support surface in a wide area outside the confines of the marking member.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION OF THE PREFERRED EMBODIMENTS

The present invention pertains to a marking device for marking a support surface or structure. The marking action of the device is generally a result of pressure applied somewhere to a device base and directed toward a surface to be marked. The force for initializing the action may be applied to the base in random areas (e.g., areas that are not restricted by the position of the device marking member). Thus, one or more marking devices may be removably secured to a measuring instrument or to an article, where the marking devices allow execution of a marking transfer action in response to force applied to areas of the instrument or article that are located some distance from the device marking member. The measuring instrument or article can be initially maneuvered along or over the surface to a desired location without providing any undesirable marks on the surface during the preparatory manipulations or initial positioning relative to the surface.

The marking device may further be utilized to mount an article with "blind" attachment points (e.g., openings or mounting hardware) on a surface. The device marks locations on the surface for installation of fasteners. For example, the marking device may be utilized to install a spoiler on the back of a car. The device base may be configured for a snap-fit (e.g., snap-in or snap-on), magnetic, adhesive or other engagement with the surface to enable the device to be releasably secured to that surface (e.g., templates, regulation plates, etc., that are widely used in the building, interior design and other industries).

Figure 1:
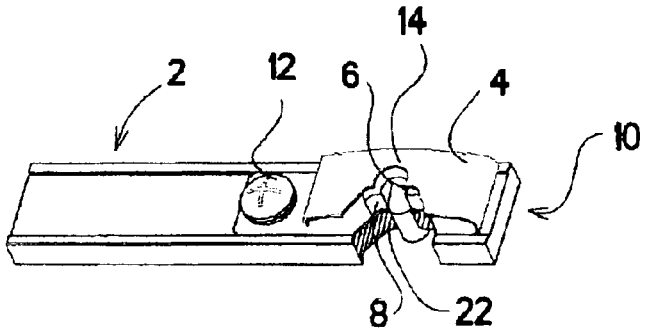
FIG. 1 is a view in perspective and partial section of a marking device according to the present invention.

A marking device according to the present invention is illustrated in FIG. 1. Specifically, marking device 10 includes a base 2, a marking member 6 attached to the base and a resilient member 4. The base is substantially rectangular, while the resilient member is in the form of a generally rectangular strip, preferably constructed of metal. A resilient member end is attached to a base intermediate portion via a fastener 12 (e.g., screw, rivet or other fastener). The resilient member extends therefrom toward a distal base end and includes a bend or fold to wrap back toward the fastener. The resilient member basically forms an overlapped area toward the base distal end. Marking member 6 is disposed on base 2 within the overlapped area and recessed relative to the upper overlapped portion of the resilient member. The marking member is typically in the form of a threaded pin or spike that engages an opening 22 defined in the base. However, the marking member may be implemented by any type of marking implement or instrument (e.g., pen, pencil, marker, etc.). A fastener 8, preferably in the form of a nut, secures the marking member position, while the threaded engagement of the marking member enables adjustment of the member height relative to the base. Resilient member 4 includes an opening or aperture 14 defined in the upper overlapped portion of the resilient member substantially coincident the marking member. Aperture 14 includes dimensions slightly greater than those of marking member 6 to enable the marking member to protrude through the aperture and place a mark on a support surface as described below. Base 2 may include securing mechanisms (e.g., snap-fit, magnetic, adhesives, etc.) to removably secure the marking device to an article. In addition, the upper overlapped portion of resilient member 4 may include felt or other covering (e.g., rubber, foam, plastic, etc.) to enable the device to be manipulated on the support surface to a desired location without leaving marks (e.g., scratches, etc.).

In operation, the marking device is removably secured to an article or may be secured to a handle or other structure for marking a surface. The device is positioned adjacent the surface with the overlapped portion of resilient member 4 contacting that surface. The device is manipulated along the surface to a desired position, where the overlapped portion of the resilient member prevents marking member 6 from contacting and marking the surface during this positioning. When a desired location is found, pressure is applied to the device or article to force the upper overlapped portion of the resilient member inward and enable the marking member to protrude through resilient member aperture 14 to contact and place a mark on the surface.

Figure 2A:
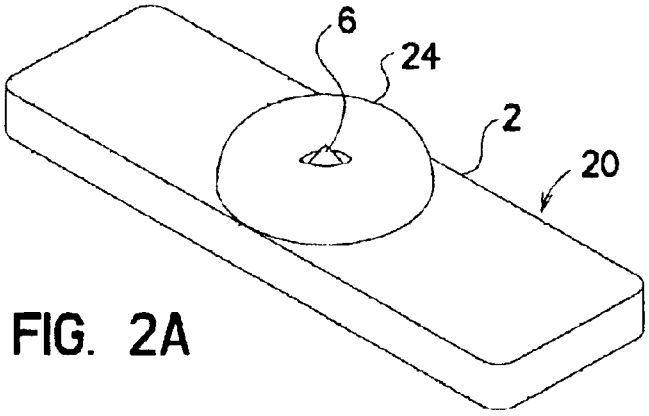
FIG. 2A is a view in perspective of an alternative embodiment of the marking device of FIG. 1 according to the present invention.
Figure 2B:
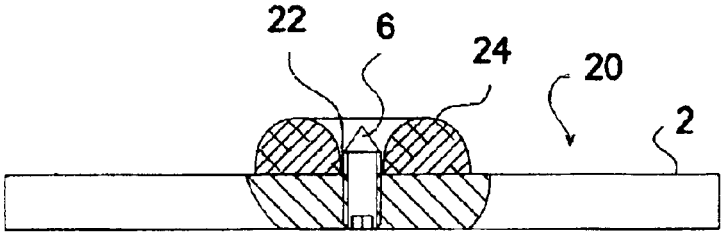
FIG. 2B is a view in elevation and partial section of the marking device of FIG. 2A.

An alternative embodiment of the marking device is illustrated in FIGS. 2A–2B. Specifically, marking device 20 includes base 2, marking member 6 attached to the base and a resilient member 24. The base and marking member are substantially similar to those described above. Base 2 is substantially rectangular, while marking member 6 is attached to a generally central location of the base. The marking member is typically in the form of a threaded pin or spike that engages opening 22 defined in the base. However, the marking member may be implemented by any type of marking implement or instrument (e.g., pen, pencil, marker, etc.) as described above. The threaded engagement enables adjustment of the marking member height relative to the base. Resilient member 24 is in the form of an annular ring with marking member 6 disposed in a substantially concentric fashion in the confines of the resilient member. Resilient member 24 is typically constructed of a resilient material (e.g., rubber, foam, etc.) and prevents marking member 6 from contacting a surface in a manner similar to that described above. In other words, the height of marking member 6 is set to be less than that of the resilient member in an uncompressed state.

In operation, marking device 20 may be removably secured to an article or secured to a handle or other structure for marking a surface. The device is positioned adjacent the surface with resilient member 24 contacting that surface. The device is manipulated along the surface to a desired position, where the resilient member prevents marking member 6 from contacting and marking the surface during this positioning. When a desired location is found, pressure is applied to the device or article to compress the resilient member inward and enable the marking member to extend beyond resilient member 24 to contact and place a mark on the surface.

Figure 3A:
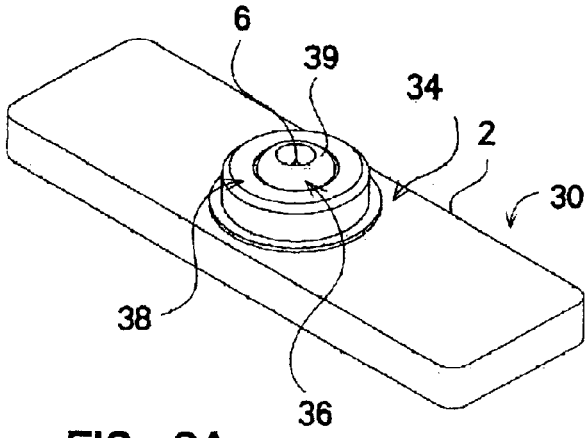
FIG. 3A is a view in perspective of yet another embodiment of the marking device of FIG. 1 according to the present invention.
Figure 3B:
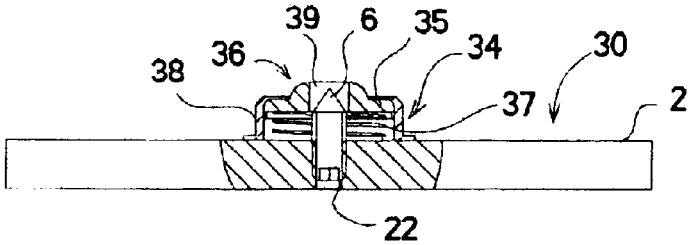
FIG. 3B is a view in elevation and partial section of the marking device of FIG. 3A.

Yet another alternative embodiment of the marking device is illustrated in FIGS. 3A–3B. Specifically, marking device 30 includes base 2, marking member 6 attached to the base and a resilient member 34. The base and marking member are substantially similar to those described above. Base 2 is substantially rectangular, while marking member 6 is attached to a generally central location of the base. The marking member is typically in the form of a threaded pin or spike that engages opening 22 defined in the base as described above. However, the marking member may be implemented by any type of marking implement or instrument (e.g., pen, pencil, marker, etc.) as described above. The threaded engagement enables adjustment of the marking member height relative to the base. Resilient member 34 includes a housing 38 and a bias member 36. Housing 38 is generally cylindrical and includes an open top portion, while bias member 36 is substantially concentrically disposed within the housing and encompasses marking member 6. Bias member 36 is in the form of a plate 35 with a raised or dome-shaped central annular portion 39. The dimensions of the raised portion are less than the open top portion of housing 38 to enable that raised portion to extend through that open portion. The plate dimensions are greater than those of the housing open top portion, thereby forming a stop against housing 38. A spring 37 is disposed around marking member 6 and between bias member 36 and base 2. The spring biases the bias member toward the housing upper portion to maintain the marking member 6 recessed within the bias member raised portion. Basically, when pressure is applied to marking device 30 toward a surface, the pressure overcomes the spring bias, thereby causing bias member 36 to compress the spring and move toward base 2. This action enables marking member 6 to protrude through the raised annular portion and mark the surface as described below. The bias member raised portion may include a covering (e.g., felt, rubber, foam, plastic, etc.) to enable the device to be manipulated on the surface without leaving marks (e.g., scratches, etc.).

In operation, marking device 30 may be removably secured to an article or to a handle or other structure for marking a surface. The device is positioned adjacent the surface with bias member 36 contacting that surface. The device is manipulated along the surface to a desired position, where bias member 36 prevents marking member 6 from contacting and marking that surface during this positioning. When a desired location is found, pressure is applied to the device or article to force the bias member inward toward the base and enable the marking member to protrude through bias member 36 to contact and place a mark on the surface.

Figure 4A:
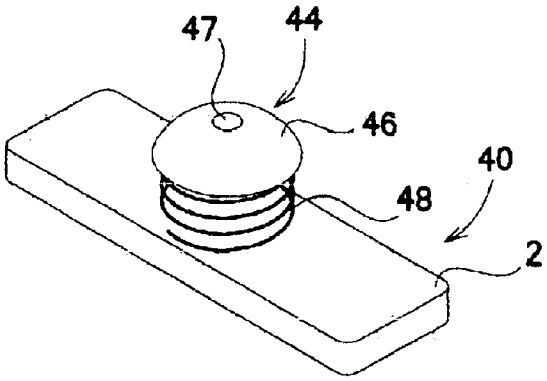
FIG. 4A is a view in perspective of still another embodiment of the marking device of FIG. 1 according to the present invention.
Figure 4B:
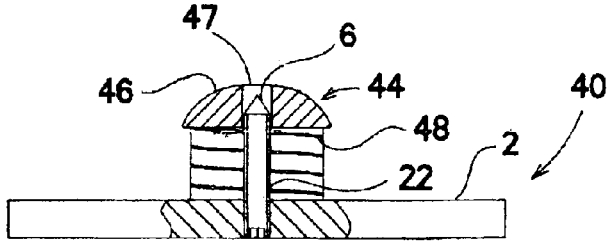
FIG. 4B is a view in elevation and partial section of the marking device of FIG. 4A.

Still another embodiment of the marking device is illustrated in FIGS. 4A–4B. Specifically, marking device 40 includes base 2, marking member 6 attached to the base and a resilient member 44. The base and marking member are substantially similar to those described above. Base 2 is substantially rectangular, while marking member 6 is attached to the base at a generally central location. The marking member is typically in the form of a threaded pin or spike that engages opening 22 defined in the base as described above. However, the marking member may be implemented by any type of marking implement or instrument (e.g., pen, pencil, marker, etc.) as described above. The threaded engagement enables adjustment of the marking member height relative to the base. Resilient member 44 includes a dome 46 and a spring 48. The dome is in the form of a tapered cylinder or sphere that includes a channel 47 defined therein. Spring 48 includes dimensions slightly less than those of the dome and is disposed about the marking member between the dome and base 2. The marking member is disposed within channel 47, while spring 48 biases the dome away from the base to maintain marking member 6 recessed within the channel. Basically, when pressure is applied to marking device 40 toward a surface, the pressure overcomes the spring bias, thereby causing dome 44 to compress the spring and move toward the base. This action enables the marking member to protrude through the dome and mark the surface as described below. The dome may include a covering (e.g., felt, rubber, foam, plastic, etc.) to enable the device to be manipulated on the surface without leaving marks (e.g., scratches, etc.).

In operation, marking device 40 may be removably secured to an article or secured to a handle or other structure for marking a surface. The device is positioned adjacent the surface with dome 46 contacting that surface. The device is manipulated along the surface to a desired position, where dome 46 prevents marking member 6 from contacting and marking the surface during this positioning. When a desired location is found, pressure is applied to the device or article to force dome 46 inward toward the base and enable the marking member to protrude through the dome to contact and place a mark on the surface.

Figure 5A:
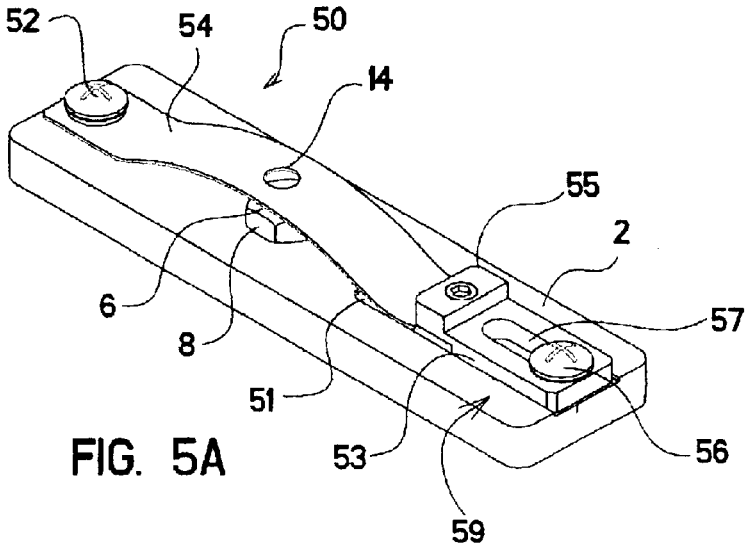
FIG. 5A is a view in perspective of a marking device including an audio indicator to indicate placement of a mark on a supporting surface according to the present invention.
Figure 5B:
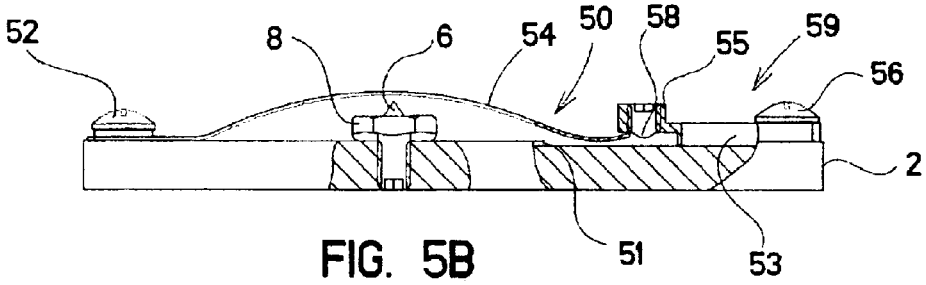
FIG. 5B is a view in elevation and partial section of the marking device of FIG. 5A.

A marking device that produces an audible indication in response to placement of a mark on a surface is illustrated in FIGS. 5A–5B. Specifically, marking device 50 includes base 2, marking member 6 attached to the base, a resilient member 54 and an audible indicator 59. The base and marking member are substantially similar to those described above. Base 2 is substantially rectangular, while marking member 6 is attached to an intermediate location of the base. The marking member is typically in the form of a threaded pin or spike that engages opening 22 defined in the base as described above. However, the marking member may be implemented by any type of marking implement or instrument (e.g., pen, pencil, marker, etc.). Fastener 8, preferably in the form of a nut, secures the marking member position, while the threaded engagement of the marking member enables adjustment of the marking member height relative to the base. Resilient member 54 is in the form of a strip, preferably constructed of metal, in a curved or arched configuration to cover the marking member. One end of the resilient member is attached to a base longitudinal end via a fastener 52 (e.g., screw, etc.). Resilient member 54 includes an opening or aperture 14 defined toward the member apex and substantially coincident the marking member to permit the marking member to protrude through the resilient member and mark a support surface when sufficient pressure is applied. The resilient member preferably includes a covering (e.g., felt, rubber, foam, plastic, etc.) to enable the device to be manipulated on a support surface to a desired location without leaving marks (e.g., scratches, etc.).

A substantially rectangular groove 51 is defined in the base toward the base longitudinal end opposing the secured resilient member end. Audible indicator 59 includes dimensions less than those of groove 51 and is disposed within the groove to provide an audible indication in response to placement of a mark on the surface. The audible indicator includes a base 53 and an audible device 55. Base 53 is substantially rectangular and includes a generally elliptical slot 57 defined therein to receive a fastener 56 (e.g., screw, etc.) to secure the audible indicator to base 2. Audible device 55 is attached to the upper portion of base 53 adjacent slot 57 to form an overhang or ledge. The unsecured end of resilient member 54 is disposed in groove 51 and is positioned adjacent audible device 55 when the resilient member is in an uncompressed state. When pressure is applied, the resilient member bends inward to enable the marking member to protrude through aperture 14 and mark the surface. The unsecured resilient member end is urged beneath audible device 55 in response to the inward bend. The unsecured end actuates an audible device actuator 58 to enable the audible device to provide an audible indication (e.g., noise, click, etc.) in response to placement of a mark on a surface. The audible device is preferably a mechanical audible device, however, any device providing an audio signal may be utilized.

In operation, marking device 50 may be removably secured to an article or may be secured to a handle or other structure for marking a surface. The device is positioned adjacent the surface with resilient member 54 contacting that surface. The device is manipulated along the surface, where resilient member 54 prevents marking member 6 from contacting that surface during this positioning. When a desired location is found, pressure is applied to the device or article to bend the resilient member inward and enable the marking member to protrude through resilient member aperture 14 to contact and place a mark on the surface. The unsecured end of the resilient member slides beneath audible device 55 to actuate actuator 58 and enable the indicator to provide an audible indication in response to placement of the mark.

Figure 6A:
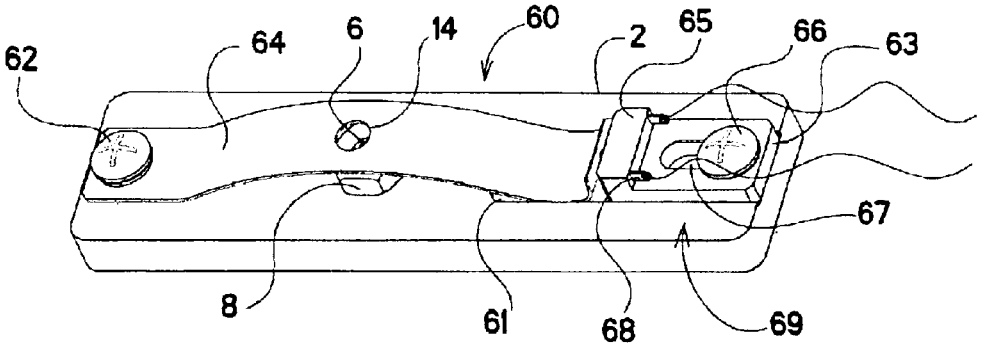
FIG. 6A is a view in perspective of a marking device including a switch to facilitate actuation of an indicator to indicate placement of a mark on a supporting surface according to the present invention.
Figure 6B:
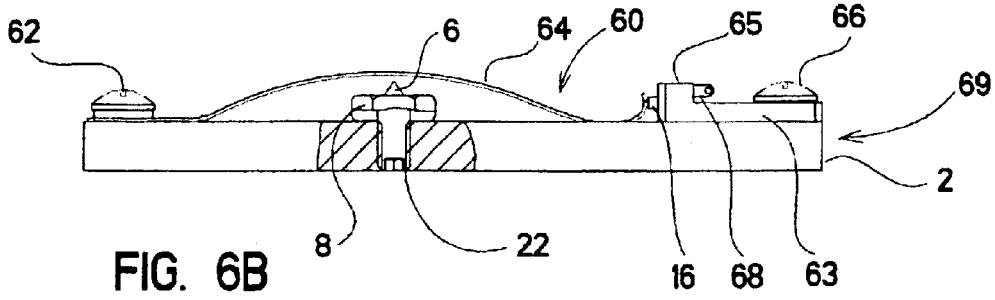
FIG. 6B is a view in elevation and partial section of the marking device of FIG. 6A.

The marking device may provide a visual or audible indication in response to placement of a mark on a surface as illustrated in FIGS. 6A–6B. Specifically, marking device 60 includes base 2, marking member 6 attached to the base, a resilient member 64 and a switching device 69. The base and marking member are substantially similar to those described above. Base 2 is substantially rectangular, while marking member 6 is attached to an intermediate location of the base. The marking member is typically in the form of a threaded pin or spike that engages opening 22 defined in the base as described above. However, the marking member may be implemented by any type of marking implement or instrument (e.g., pen, pencil, marker, etc.). Fastener 8, preferably in the form of a nut, secures the marking member position, while the threaded engagement of the marking member enables adjustment of the marking member height relative to the base. Resilient member 64 is in the form of a strip, preferably constructed of metal, in a curved or arched configuration to cover the marking member. One end of the resilient member is attached to a base longitudinal end via a fastener 62 (e.g., screw, etc.). Resilient member 64 includes opening or aperture 14 defined therein toward the member apex and substantially coincident the marking member to permit the marking member to protrude through the resilient member and mark a support surface when sufficient pressure is applied. The resilient member preferably includes a covering (e.g., felt, rubber, foam, plastic, etc.) to enable the device to be manipulated on a support surface to a desired location without leaving marks (e.g., scratches, etc.).

A substantially rectangular groove 61 is defined in the base toward a base longitudinal end opposing the secured resilient member end. Switching device 69 includes dimensions less than those of groove 61 and is disposed within the groove to provide an electrical signal to a visual or audible indicator (not shown) in response to placement of a mark on the surface. Switching device 69 includes a base 63 and a switch 65. Base 63 is substantially rectangular and includes a generally elliptical slot 67 defined therein to receive a fastener 66 (e.g., screw, etc.) to secure the switching device to base 2. Switch 65 is in the form of a momentary type switch and is attached to base 63 adjacent slot 67. The switch includes terminals 68 to provide the electrical signal in response to placement of the mark. The switch front surface includes an actuator 16 to enable the switching device to provide the electrical signal. The unsecured end of the resilient member is disposed in groove 61 and includes an upward curving configuration. The unsecured end is positioned adjacent the switch actuator when the resilient member is in an uncompressed state. When pressure is applied, the resilient member bends inward to enable the marking member to protrude through aperture 14 and mark the surface. The unsecured end of the resilient member is urged toward the switch actuator in response to the inward bend and actuates the switching device to provide the electrical signal. Terminals 68 of the switch are connected to a visual or audible indicator (e.g., light, buzzer, beeper, etc.) to provide a visual or audible indication in response to placement of a mark on the surface.

In operation, marking device 60 may be removably secured to an article or may be secured to a handle or other structure for marking a surface. The device is positioned adjacent the surface with resilient member 64 contacting that surface. The device is manipulated along the surface, where resilient member 64 prevents marking member 6 from contacting that surface during the article positioning. When a desired location is found, pressure is applied to the device or article to bend the resilient member inward and enable the marking member to protrude through resilient member aperture 14 to contact and place a mark on the support surface. The unsecured end of the resilient member is urged against the switch actuator to actuate the switch and provide an electrical signal to a visual or audible indicator. The indicator provides a visual or audible indication to the user in response to placement of a mark on a surface.

The present invention marking devices may be utilized for various applications. For example, the devices may be utilized to indicate locations on a supporting surface for security type fasteners to suspend picture frames or other articles. Currently, security or frame locking type systems or devices are employed for hanging picture and mirror frames and the like on a wall. These systems restrict frame mobility on the wall and enable detachment of the frame from the wall only by use of a special tool or wrench, thereby preventing unauthorized removal. The systems usually include two or more slotted brackets attached to the upper portion of the frame and one or more slotted brackets attached to the lower portion of the frame. The upper slotted brackets typically engage generally 'S'-shaped brackets mounted on the wall or other support surface, while the lower slotted brackets typically engage 'T'-screws mounted on that surface.

In order to attach a frame to a wall with these systems, 'S'-shaped wall brackets engage the frame upper slotted brackets, while one or more T-screws engage one or more frame lower slotted brackets. The 'S'-shaped brackets and T-screws are fastened to a wall at positions that enable engagement with the slotted brackets on the frame. Since the slotted brackets are located on the back of the frame (e.g., in blind spots), secure installation of the frame at an exact predetermined position on the wall is complex. Conventional techniques to accomplish this installation require a substantial number of measurements and calculations. This is a cumbersome procedure that requires a substantial amount of time and experience and typically provides numerous accidental marks and scratches on a wall.

The present invention marking device may be utilized for the security installation, thereby enabling the installation to be accomplished in significantly less time and by relatively inexperienced personnel. Engagement of the frame slotted brackets with the supporting wall hardware (e.g., 'S'-shaped brackets and 'T'-screw) at the desired frame position on the wall are typically achieved in the first attempt. The present invention includes a set of marking devices or locators for the upper and lower slotted brackets. The difference between the upper and lower locators is the position of a device marking member relative to the position of the slotted bracket on the frame. The marking member for the upper locators are offset from the position of the slotted bracket on the frame. This accounts for the offset between the location where the 'S'-shaped bracket engages the wall and the location where the 'S'-shaped bracket engages the frame. In other words, the location on the wall for mounting the 'S'-shaped bracket is offset from the location where that bracket engages the frame. The upper locator employs a similar offset for the marking member to mark appropriate locations on the wall for installation of the brackets. The lower locator marking members are coincident the positions of the slotted brackets on the frame for consistency with the position of their corresponding fastener (e.g., 'T'-screw) on the wall.

Figure 7A:
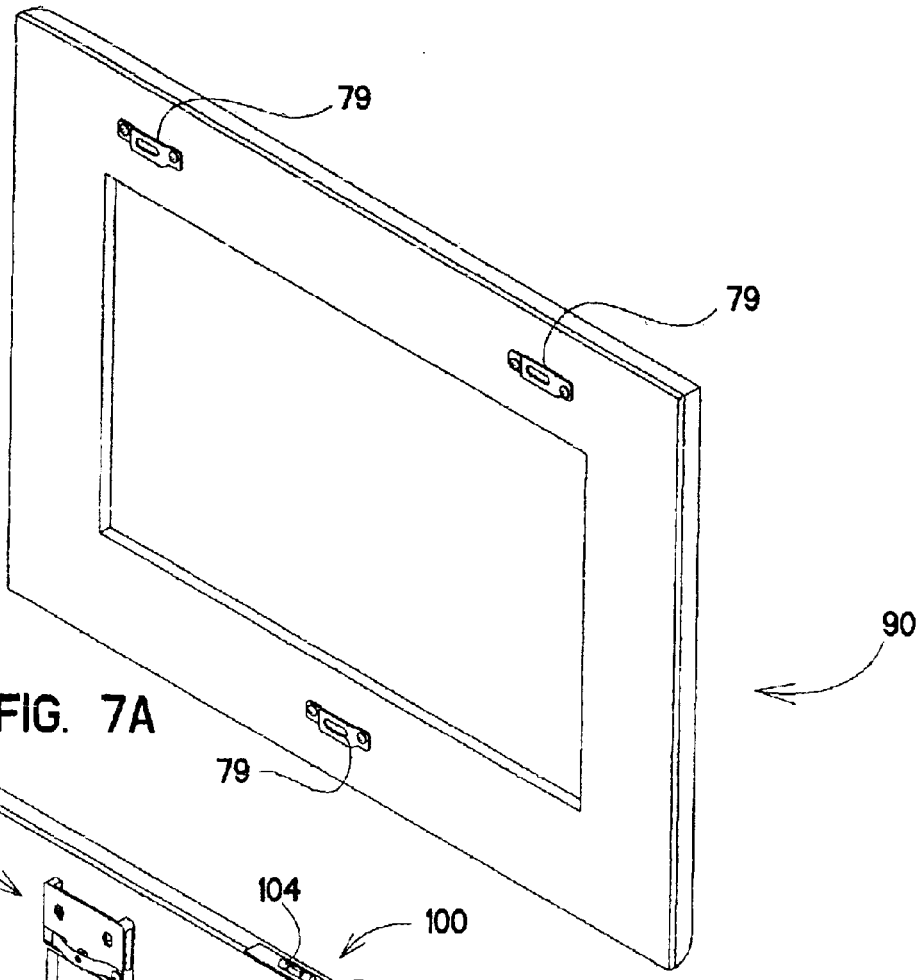
FIGS. 7A–7B are views in perspective of an exemplary picture frame with upper and lower marking devices of the present invention mounted on frame security brackets.
Figure 7B:
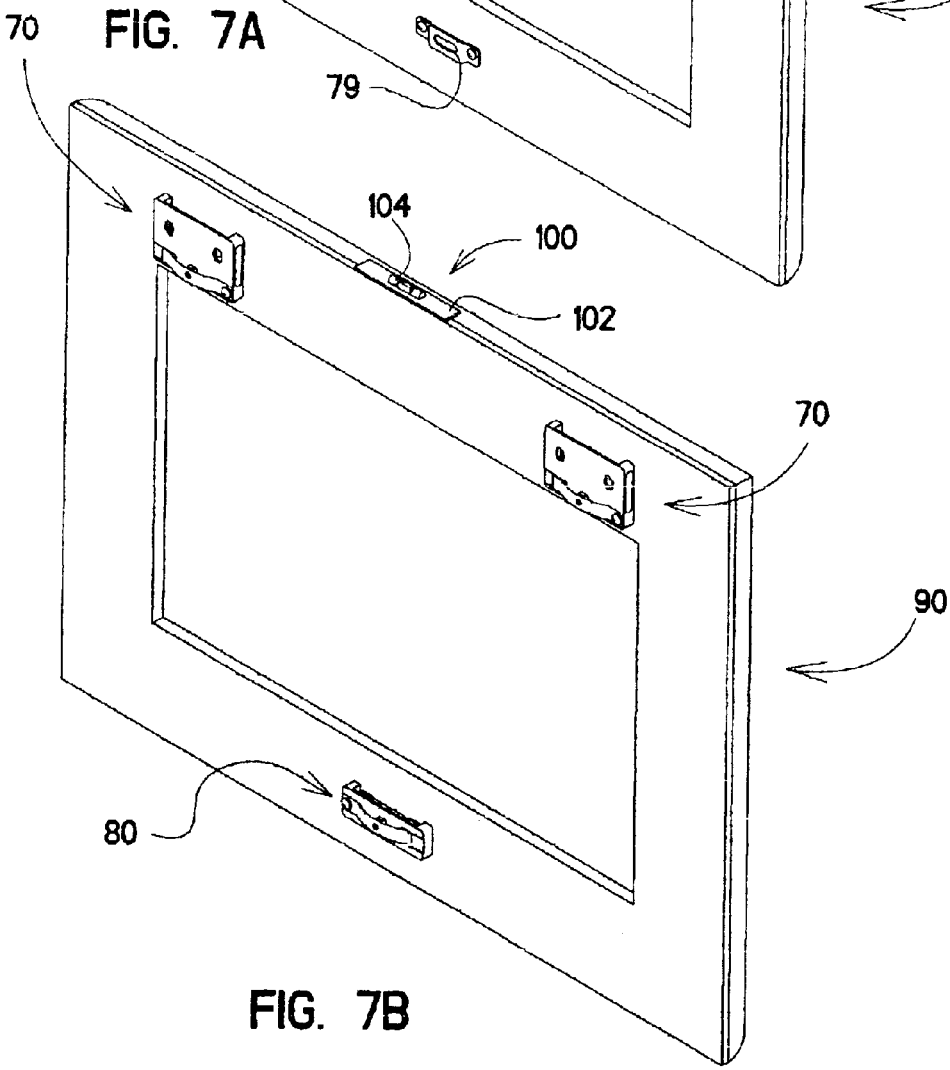
Figure 8A:
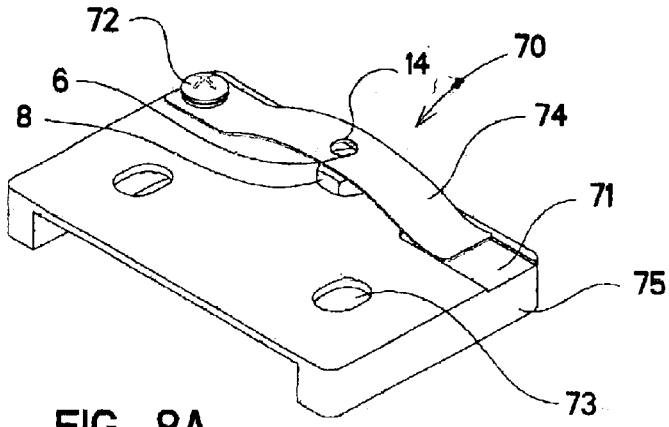
FIG. 8A is a view in perspective of the upper marking device of FIG. 7B.
Figure 8B:
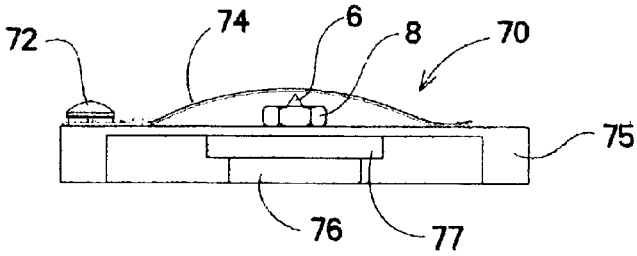
FIG. 8B is a view in elevation of the upper marking device of FIG. 8A.

Marking devices for installation of an article on a wall via a security type system are illustrated in FIGS. 7A–7B. Specifically, a frame 90 includes a series of security type slotted brackets 79. The frame is substantially rectangular with a pair of brackets 79 each disposed toward an upper frame comer and another bracket 79 disposed toward the center of the lower frame portion. Upper marking devices or locators 70 are releasably mounted on the upper frame brackets, while a lower locator or marking device 80 is releasably mounted on the lower frame bracket. The locators each include a marking member as described below to mark locations on the wall for placement of fasteners. A level device 100 may be placed on one of the frame horizontal surfaces or planes. The level device includes an adhesive or sticky base 102 and a conventional bubble type level 104. The adhesive base is substantially rectangular, while level 104 is attached to a generally central location on the base. An adhesive is disposed on the underside of the base to enable the level device to be removably secured on the frame during preparatory manipulations, thereby preventing level device 100 from falling. The level device generally employs an adhesive in the form of a double stick tape or other material applied to the base that may be replaced with fresh adhesive material in time as needed. However, any other tapes or adhesives may be employed. The frame is placed adjacent and manipulated along the wall to a desired location. The configuration of each locator prevents a corresponding marking member from contacting the wall during this positioning. When the frame position on a wall has been established, the level device is examined for proper orientation, where the frame position may be adjusted as needed. Manual pressure on the frame toward the wall is applied, generally in the vicinity of the mounted locators, to enable the marking members of the locators to provide appropriate marks and/or imprints on the wall to identify locations for fasteners as described below.

Figure 9A:
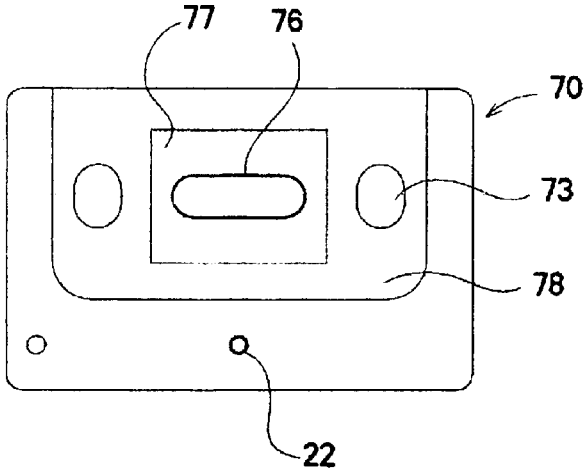
FIG. 9A is a view in elevation of the rear surface of the upper marking device of FIG. 8A for engaging a picture frame mounting bracket.
Figure 9B:
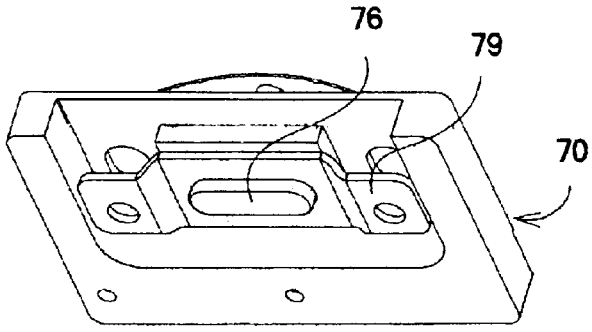
FIG. 9B is a view in perspective of the upper marking device of FIG. 8A engaging a security bracket.
Figure 10A:
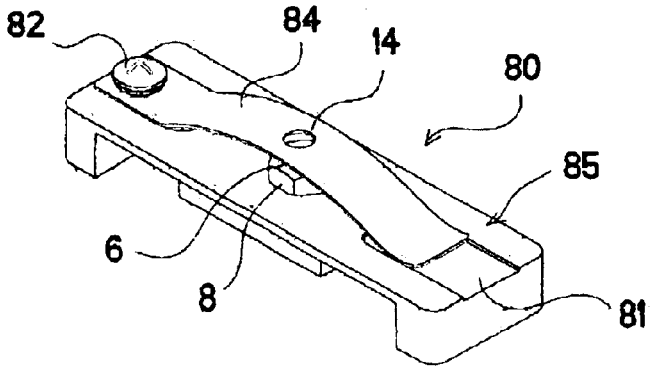
FIG. 10A is a view in perspective of the lower marking device of FIG. 7B.
Figure 10B:
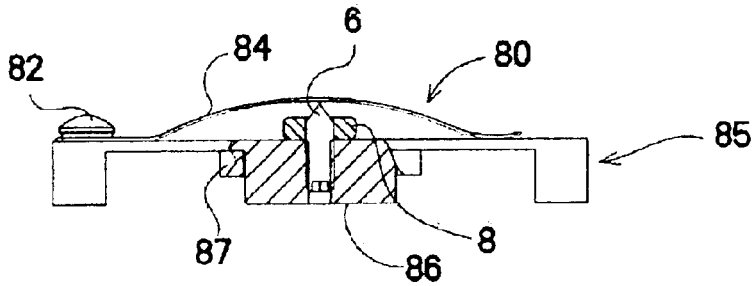
FIG. 10B is a view in elevation and partial section of the lower marking device of FIG. 10A.

An upper marking device or locator 70 is illustrated in FIGS. 8A–8B and 9A–9B. Specifically, upper locator 70 includes a base 75, marking member 6 attached to the base and a resilient member 74. The base is substantially rectangular with rounded comers and includes a recessed portion 78 (FIG. 9A) defined in the base rear surface that faces slotted bracket 79 of frame 90 (FIG. 7A). The recessed portion is generally rectangular and extends from the upper edge of locator 70 toward the locator lower edge. A substantially rectangular magnetic strip 77 is disposed within recessed portion 78. The magnetic strip includes dimensions less than those of the recessed portion. A generally elliptical projection or post 76 is disposed at a generally central location of the recessed portion on the base rear surface and extends through magnetic strip 77. The dimensions of the projection are slightly less than those of the slot within bracket 79 to enable the projection to be inserted within and engage the slot for mounting locator 70 on that bracket (FIG. 9B). Substantially elliptical windows 73 are defined in the base front surface. The windows enable observation of fasteners (e.g., screws) that fasten slotted bracket 79 to frame 90 in order to assist a user in mounting locator 70 to the bracket. In other words, the windows provide visibility to a user to facilitate insertion of projection 76 into the slot of a corresponding bracket 79. Magnetic strip 77 engages surrounding portions of the slotted bracket to secure locator 70 to that bracket.

The base front surface (FIGS. 8A–8B) includes marking member 6 and resilient member 74 attached thereto. The marking member is substantially similar to the marking member described above. The marking member is attached to the base front surface at an intermediate location toward the locator lower edge. The marking member is typically in the form of a threaded pin or spike that engages opening 22 (FIG. 9A) defined in the base as described above. However, the marking member may be implemented by any type of marking implement or instrument (e.g., pen, pencil, marker, etc.). Fastener 8, preferably in the form of a nut, secures the marking member position, while the threaded engagement of the marking member enables adjustment of the marking member height relative to the base. Resilient member 74 is in the form of a strip, preferably constructed of metal, in a curved or arched configuration to cover the marking member. One end of the resilient member is attached to a base longitudinal end via a fastener 72 (e.g., screw, etc.). Resilient member 74 includes opening or aperture 14 defined therein toward the member apex and substantially coincident the marking member to permit the marking member to protrude through the resilient member and mark a support surface when sufficient pressure is applied. The resilient member preferably includes a covering (e.g., felt, rubber, foam, plastic, etc.) to enable the device to be manipulated on a support surface to a desired location without leaving marks (e.g., scratches, etc.).

A substantially rectangular groove 71 is defined in the base toward a base longitudinal end opposing the secured resilient member end. The unsecured resilient member end is disposed in the groove, where the groove basically serves as a guide for motion of the resilient member when the resilient member compresses or bends inward in response to pressure applied to the frame as described below. Basically, the unsecured resilient member end slides within the groove in response to compression of the resilient member. The position of the marking member is offset from the location of projection 76 engaging the slotted bracket. This offset is utilized to identify an appropriate location for the 'S'-shaped bracket on the wall to engage bracket 79 (FIG. 7A) of the frame. In other words, the location where the 'S'-shaped bracket is mounted to the wall differs (e.g., vertically) from the location where the bracket engages the frame slotted bracket. The locator offset accounts for this difference to enable installation of the 'S'-shaped bracket on the wall at a proper location as described above.

Figure 11A:
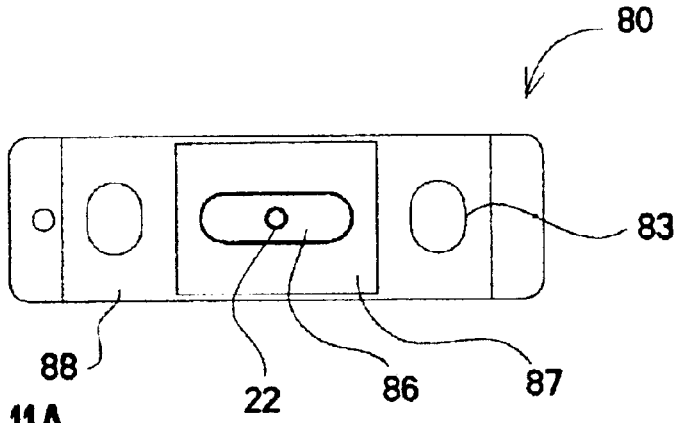
FIG. 11A is a view in elevation of the rear surface of the lower marking device of FIG. 10A for engaging a picture frame mounting bracket.
Figure 11B:
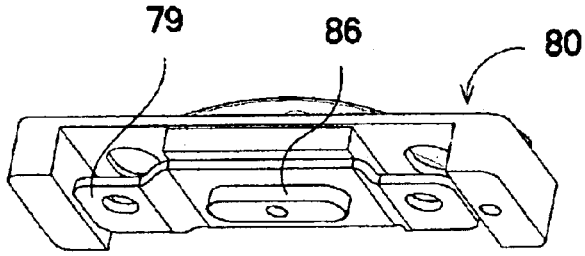
FIG. 11B is a view in perspective of the lower marking device of FIG. 10A engaging a security bracket.

A lower locator 80 is illustrated in FIGS. 10A–10B and 11A–11B. Initially, lower locator 80 is substantially similar to upper locator 70 described above, except that the marking member is positioned coincident the projection (e.g., locator 80 does not include the offset between the marking member and the center of the slotted bracket of frame 90 (FIG. 7A)). Specifically, locator 80 includes a base 85, marking member 6 attached to the base and a resilient member 84. The base is substantially rectangular and includes a recessed portion 88 (FIG. 11A) defined in the base rear surface that faces slotted bracket 79 of frame 90 (FIG. 7A). The recessed portion is substantially rectangular and covers the intermediate portion between the locator side edges. A magnetic strip 87 is disposed within recessed portion 88. The magnetic strip includes dimensions less than those of the recessed portion. A generally elliptical projection or post 86 is disposed at a generally central location on the base rear surface and extends through magnetic strip 87. The dimensions of the projection are slightly less than those of the slot within bracket 79 to enable the projection to be inserted within and engage the slot for mounting of locator 80 on that bracket (FIG. 11B). A series of substantially elliptical windows 83 are defined in the base rear surface toward opposing recess portion edges and surrounding projection 86. The windows provide visibility to a viewer to facilitate insertion of the post within the slotted bracket as described above. Magnetic strip 87 engages surrounding portions of the slotted bracket to secure locator 80 to that bracket.

The base front surface (FIGS. 10A–10B) includes marking member 6 and resilient member 84 attached thereto. The marking member is substantially similar to the marking member described above. The marking member is attached to the base front surface at an intermediate location, coincident projection 86. The marking member is typically in the form of a threaded pin or spike that engages opening 22 (FIG. 11A) defined in the base as described above. However, the marking member may be implemented by any type of marking implement or instrument (e.g., pen, pencil, marker, etc.). Fastener 8, preferably in the form of a nut, secures the marking member position, while the threaded engagement of the marking member enables adjustment of the marking member height relative to the base. Resilient member 84 is in the form of a strip, preferably constructed of metal, in a curved or arched configuration to cover the marking member. One end of the resilient member is attached to a base longitudinal end via a fastener 82 (e.g., screw, rivet, etc.). Resilient member 84 includes opening or aperture 14 defined therein toward the member apex and substantially coincident the marking member to permit the marking member to protrude through the resilient member and mark a support surface when sufficient pressure is applied. The resilient member preferably includes a covering (e.g., felt, rubber, foam, plastic, etc.) to enable the device to be manipulated on a support surface to a desired location without leaving marks (e.g., scratches, etc.).

A substantially rectangular groove 81 is defined in the base toward a base longitudinal end opposing the secured resilient member end. The unsecured resilient member end is disposed in the groove, where the groove basically serves as a guide for motion of the resilient member end when the resilient member compresses or bends inward in response to pressure applied to the frame as described below. Basically, the unsecured resilient member end slides within the groove in response to compression of the resilient member.

In operation, upper and lower locators 70 and 80 are mounted on corresponding upper and lower brackets 79 of frame 90. This is accomplished by inserting the locator projections into the bracket slots as described above. The frame is positioned adjacent the wall, where the locator resilient members may contact the wall. The frame is manipulated along the wall to a desired location, where the resilient members prevent the locator marking members from contacting that wall during this positioning. The level device may be utilized to ensure proper orientation of the frame on the wall as described above. When a desired location is found, pressure is applied to the frame to bend the locator resilient members inward and enable the marking members to protrude through the resilient member apertures and place a mark on the wall. Once the wall is marked, appropriate fasteners (e.g., 'S'-shaped brackets, 'T'-screws, etc.) may be installed on the wall at those locations to mount the frame in a desired and secure manner on the wall.

Figure 12A:
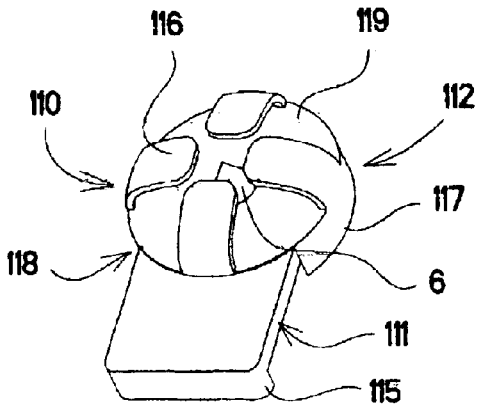
FIG. 12A is a view in perspective of an application specific upper marking device according to the present invention.
Figure 12B:
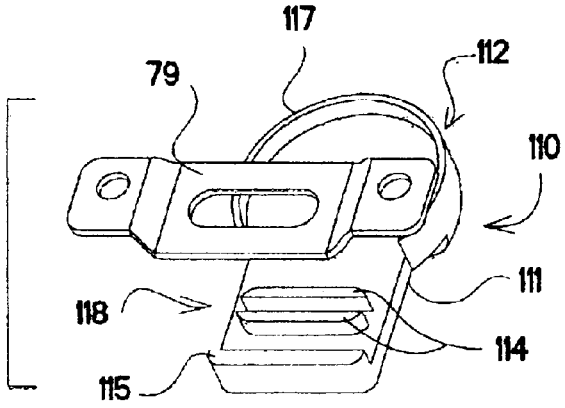
FIG. 12B is an exploded view in perspective of the upper marking device of FIG. 12A mounted on a bracket.

The marking devices or locators may be manufactured from a single block of material (e.g., without any subsequent assemblies), such as plastic or other materials, by injection molding, extrusion, or other processes. These locators are application or mounting hardware specific and may include various configurations that are specifically designed to accommodate particular article mounting hardware or mechanisms and support surface fasteners (e.g., 'L'-bracket, nail, screw, hook, etc.). The resilient member of these hardware specific locators may similarly include various configurations depending upon a particular application, article weight or support surface material. The locators may be removably secured to article mounting hardware via any suitable technique (e.g., snap-fit, magnetic, adhesive or other engagement). These locators may be disposable and may be predisposed on article mounting hardware before the article is purchased or otherwise obtained. An exemplary hardware specific locator for an upper slotted bracket 79 (FIG. 7A) is illustrated in FIGS. 12A–12B. Specifically, upper locator 110 includes a base 118, marking member 6 attached to the base and resilient members 116. The marking member is similar to the marking member described above and may be in the form of a pin or spike. However, the marking member may be implemented by any type of marking implement or instrument (e.g., pen, pencil, marker, etc.). The base includes a marking section 112 and an offset section 111. The offset section is generally rectangular and includes a ledge 115 attached to an offset section bottom edge. Marking section 112 includes a generally circular disk 119 attached to an offset section upper edge. Marking member 6 is disposed at a generally central location of disk 119, while the disk includes a peripheral ledge 117 extending downward from the disk peripheral edges. Resilient members 116 are generally in the form of finger-like projections extending from the peripheral edges of disk 119 and curving inward toward marking member 6. The resilient members are angularly displaced from each other by approximately ninety degrees and extend above disk 119 for a distance greater than the height of the marking member. In other words, the marking member is recessed relative to the resilient members. The area above marking member 6 is open to enable the marking member to protrude beyond the resilient members and mark the wall in response to applied pressure as described below. The resilient members are typically constructed of suitable materials that enable the frame to be manipulated on the wall toward a desired location without leaving marks (e.g., scratches, etc.). However, the resilient members may include a covering (e.g., felt, rubber, foam, plastic, etc.) to further prevent inadvertent marking of the wall during frame positioning.

The rear surface of offset section 111 (FIG. 12B) includes projections 114 disposed adjacent ledge 115. Each projection is generally semi-elliptical, where the combined dimensions of the projections are similar to the dimensions of the slot within bracket 79. Projections 114 are spaced apart by a slight distance to enable a snug or snap fit engagement with the slot of bracket 79. The projections are offset from the marking member to account for the offset between the location where an 'S'-shaped bracket engages a wall and the location where the 'S'-shaped bracket engages the frame as described above.

Figure 13A:
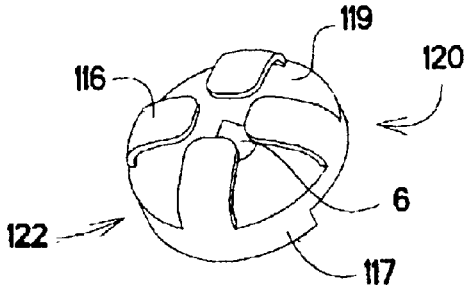
FIG. 13A is a view in perspective of an application specific marking device according to the present invention.
Figure 13B:
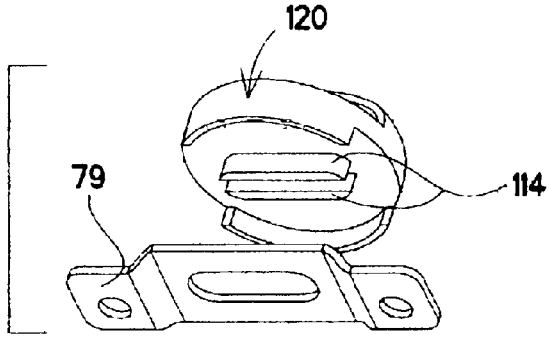
FIG. 13B is an exploded view in perspective of the marking device of FIG. 13A mounted on a bracket.

An exemplary hardware specific locator for a lower slotted bracket 79 (FIG. 7A) is illustrated in FIGS. 13A–13B. Initially, locator 120 is substantially similar to locator 110 described above, except that projections 114 of locator 120 are disposed coincident marking member 6 (e.g., locator 120 does not include offset section 115). Specifically, locator 120 includes a base 122, marking member 6 attached to the base and resilient members 116. Base 122 is substantially similar to marking section 112 described above and includes generally circular disk 119 with marking member 6 disposed thereon at a generally central location. The marking member is substantially similar to the marking member of locator 110 described above and may be in the form of a pin or spike. However, the marking member may be implemented by any type of marking implement or instrument (e.g., pen, pencil, marker, etc.). Disk 119 includes peripheral ledge 117 that extends downward from the disk peripheral edges. Resilient members 116 are generally in the form of finger-like projections extending from the peripheral edges of disk 119 and curving inward toward marking member 6. The resilient members are angularly displaced from each other by approximately ninety degrees, and extend above disk 119 for a distance greater than the height of the marking member as described above. The area above marking member 6 is open to enable the marking member to protrude beyond the resilient members and mark the wall in response to applied pressure as described below. The resilient members are typically constructed of suitable materials that enable the frame to be manipulated on the wall toward a desired location without leaving marks (e.g., scratches, etc.) as described above. However, the resilient members may include a covering (e.g., felt, rubber, foam, plastic, etc.) to further prevent inadvertent marking of the wall during frame positioning.

The rear surface of disk 119 (FIG. 13B) includes projections 114 substantially similar to the projections described above. Each projection is generally semi-elliptical, where the combined dimensions of the projections are similar to the dimensions of the slot within bracket 79. The projections are spaced apart by a slight distance to enable a snug or snap-fit engagement with the slot of bracket 79. Projections 114 are disposed coincident marking member 6 to identify locations on the wall for corresponding fasteners.

The marking procedure for the hardware specific locators is substantially the same as that described above. In the case of disposable locators, these locators may be discarded after a single use or re-used a limited quantity of times. In particular, locators 110, 120 (FIGS. 12A and 13A) are removably secured to frame brackets 79 (FIG. 7A). This is typically accomplished by insertion of projections 114 into the bracket slots as described above. The frame is positioned adjacent the wall, where resilient members 116 may contact the wall. The frame is manipulated along the wall, where the resilient members prevent the locator marking members from marking the wall during the frame positioning. Level device 100 may be employed on the frame and the frame position adjusted as necessary in accordance with the level device to ensure proper orientation. When a desired location is found, pressure is applied to the frame, generally in the vicinity of the locators, to bend the resilient members inward and enable the marking member to extend beyond the bent resilient members and place a mark on the wall.

Figure 14A:
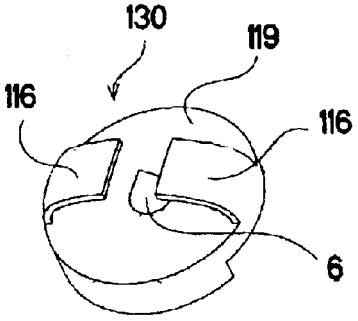
FIGS. 14A–14B are alternative embodiments of application specific marking devices according to the present invention.

The hardware specific locators may include various configurations to accommodate varying article mounting hardware and support surface fasteners as described above. In addition, the resilient members may similarly include various configurations for particular applications and articles. For example and with reference to FIG. 14A, hardware specific locator 130 for a lower slotted bracket is substantially similar to locator 120 described above and includes generally circular disk 119, marking member 6 and resilient members 116 extending from the disk peripheral edges. Marking member 6 is disposed at a generally central location on the disk as described above. Resilient members 116 are generally in the form of rectangular projections extending from the disk peripheral edges and curving inward toward the marking member. The resilient members are angularly displaced from each other by approximately one-hundred eighty degrees and extend above disk 119 for a distance greater than the height of the marking member as described above. The area above marking member 6 is open to enable the marking member to protrude beyond the resilient members and mark the wall as described above. The resilient members are typically constructed of suitable materials that enable the frame to be manipulated on the wall toward a desired location without leaving marks (e.g., scratches, etc.) as described above. However, the resilient members may include a covering (e.g., felt, rubber, foam, plastic, etc.) to further prevent inadvertent marking of the wall during frame positioning.

Figure 14B:
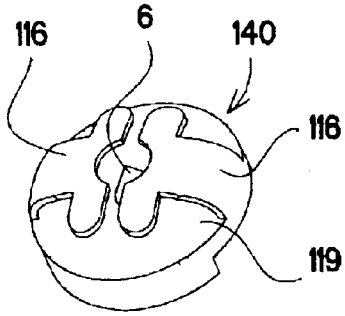

An alternative resilient member configuration for a hardware specific locator is illustrated in FIG. 14B. Specifically, locator 140 is substantially similar to locator 130 described above, except that resilient members 116 include a slightly modified configuration. Specifically, locator 140 includes generally circular disk 119, marking member 6 and resilient members 116 extending from the disk peripheral edges. Marking member 6 is disposed at a generally central location of the disk as described above. Resilient members 116 are each generally 'T'-shaped with the upper edge of each resilient member including a generally semi-circular recess. The resilient members extend from the disk peripheral edges and curve inward toward the marking member. The resilient members are angularly displaced from each other by approximately one-hundred eighty degrees and extend above disk 119 for a distance greater than the height of the marking member as described above. The recesses of each member collectively form an opening or aperture above marking member 6 to enable the marking member to protrude beyond the resilient members and mark the wall as described above. The resilient members are typically constructed of materials that enable the frame to be manipulated on the wall toward a desired location without leaving marks (e.g., scratches, etc.) as described above. However, the resilient members may include a covering (e.g., felt, rubber, foam, plastic, etc.) to further prevent inadvertent marking of the wall during frame positioning.

Locators 130, 140 are generally designed for lower slotted brackets 79 (FIG. 7A) and include projections 114 on the rear surface thereof for engagement with corresponding brackets 79 in substantially the same manner described above. However, the configurations of FIGS. 14A–14B may equally be applied to any type of wall fasteners or mounting hardware (e.g., projections 114 may be offset from the marking member in substantially the same manner described above for locator 110). Locators 130, 140 operate in substantially the same manner described above for locators 110, 120 to place marks at appropriate locations on a wall for installation of fasteners thereon to mount the frame on the wall.

Mounting picture and mirror frames at a desired position on a wall involves numerous measurements, calculations and markings as described above. This process is especially cumbersome when fastening points are not visible to a user (e.g., in "blind spots"). Moreover, safe and steady mounting of the frame on a wall is virtually impossible to achieve when a single point of attachment (e.g., one fastener/hook, etc.) is employed, especially with respect to large and heavy frames. The Art Facts Organization states in its standard that this attachment technique places tremendous tension on the frame, hangers and suspension wire. The tension often breaks the wire, withdraws hangers, splits the frame and/or bows the frame members. Two points of attachment are strongly recommended by this organization to relieve the frame from stress and to greatly increase stability on a wall, thereby minimizing slippage, tilt and other undesirable motions. This is especially applicable in places where the frame is likely to be manipulated or displaced (e.g., places of public gatherings, hospitality facilities, children's rooms, regions exposed to earthquakes, etc.).

Figure 15A:
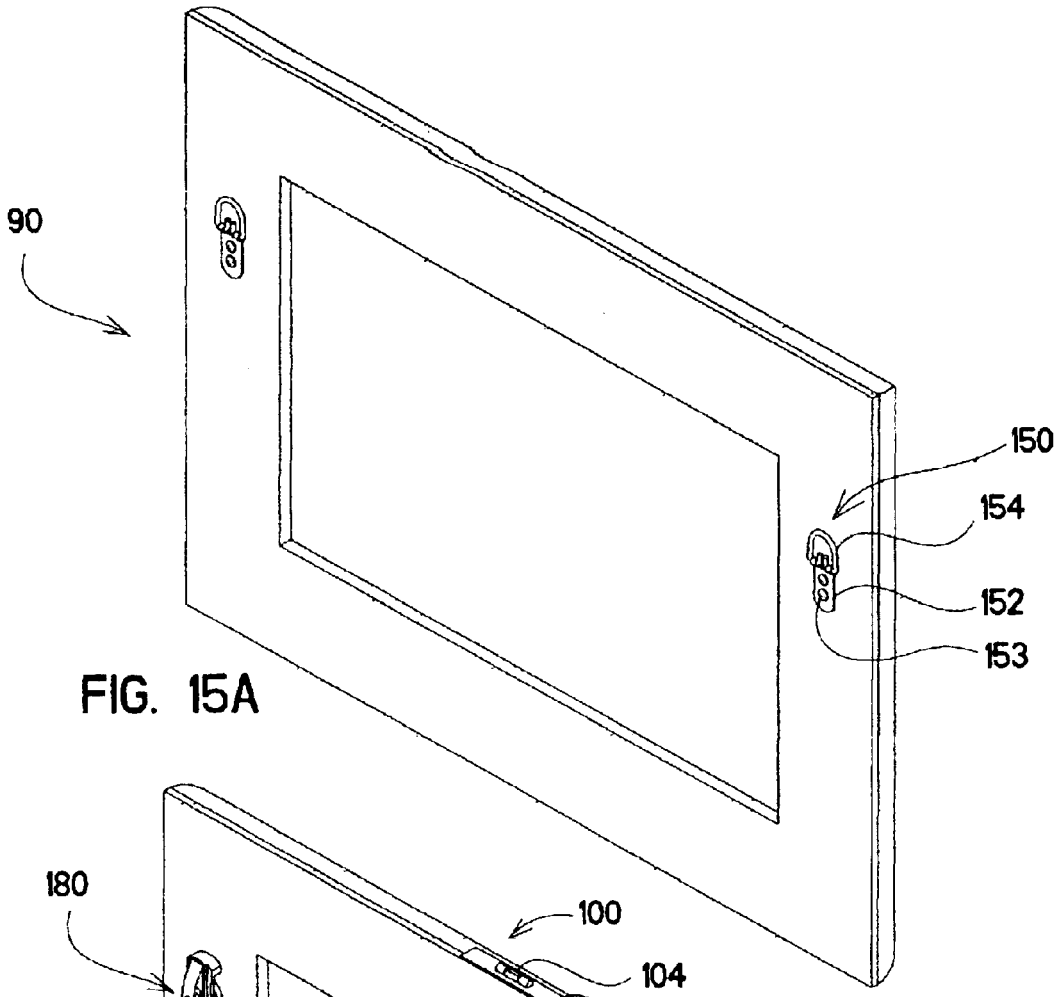
FIG. 15A is a view in perspective of an exemplary picture frame with ring type or strap hangers.
Figure 15B:
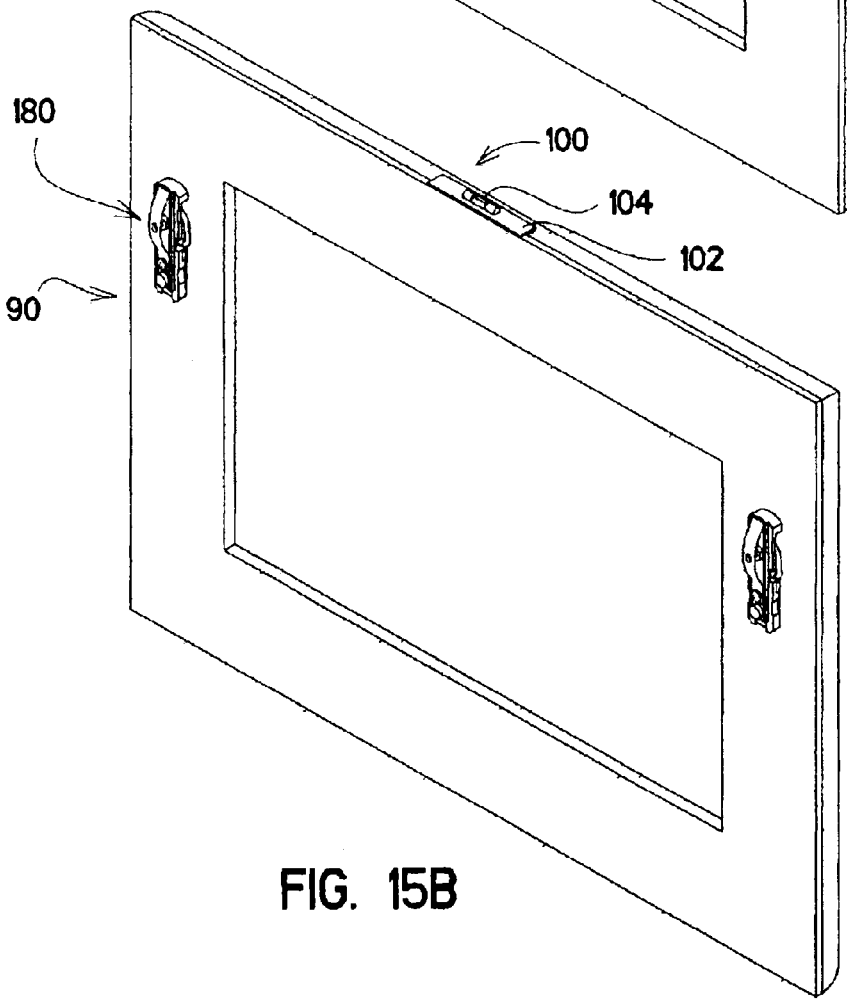
FIG. 15B is a view in perspective of the exemplary picture frame of FIG. 15A with adjustable or universal marking devices of the present invention mounted on frame ring type or strap hangers and a present invention level device placed on a frame plane or surface.

In order to provide two points of attachment, 'D'-ring type or strap hangers, typically disposed on the back of a frame, may be utilized to suspend the frame from a support surface. Accordingly, an adjustable marking device or locator of the present invention to accommodate these and other types of hangers is illustrated in FIGS. 15A–15B. The adjustable or universal locators permit the user to mount frames at the desired wall position in a steady manner utilizing the ring or keyhole type hangers on an article, thereby obviating the need to utilize a suspension wire in the hanging process. Further, the adjustable locators allow a user to evaluate (e.g., visually or in some other manner) the position of a frame on a supporting surface by maneuvering the frame into various positions without leaving any undesirable marks on the supporting surface. Moreover, the adjustable locators enable various security hanging schemes as described below.

Specifically, ring type or strap hangers 150 are typically disposed on opposing sides of frame 90 toward the frame upper portions. The hangers include a base 152 and a ring 154. The base is attached to the frame by fasteners 153 (e.g., screws, etc.), while the ring is generally 'D'-shaped. A wire or cord may be attached to and between the rings for suspending the frame from a supporting surface. This technique utilizes a single point of attachment that causes stress on the frame and instability as described above. However, the adjustable locators of the present invention may be releasably mounted on the hangers to mark fastener locations on the support surface and enable the hanger to directly engage fasteners on the support surface. Thus, the locators enable suspension of the frame from two attachment points, thereby obviating the need to use the wire or cord. Level device 100 described above may be placed on a frame horizontal surface or plane to ensure proper frame orientation.

Figure 16A:
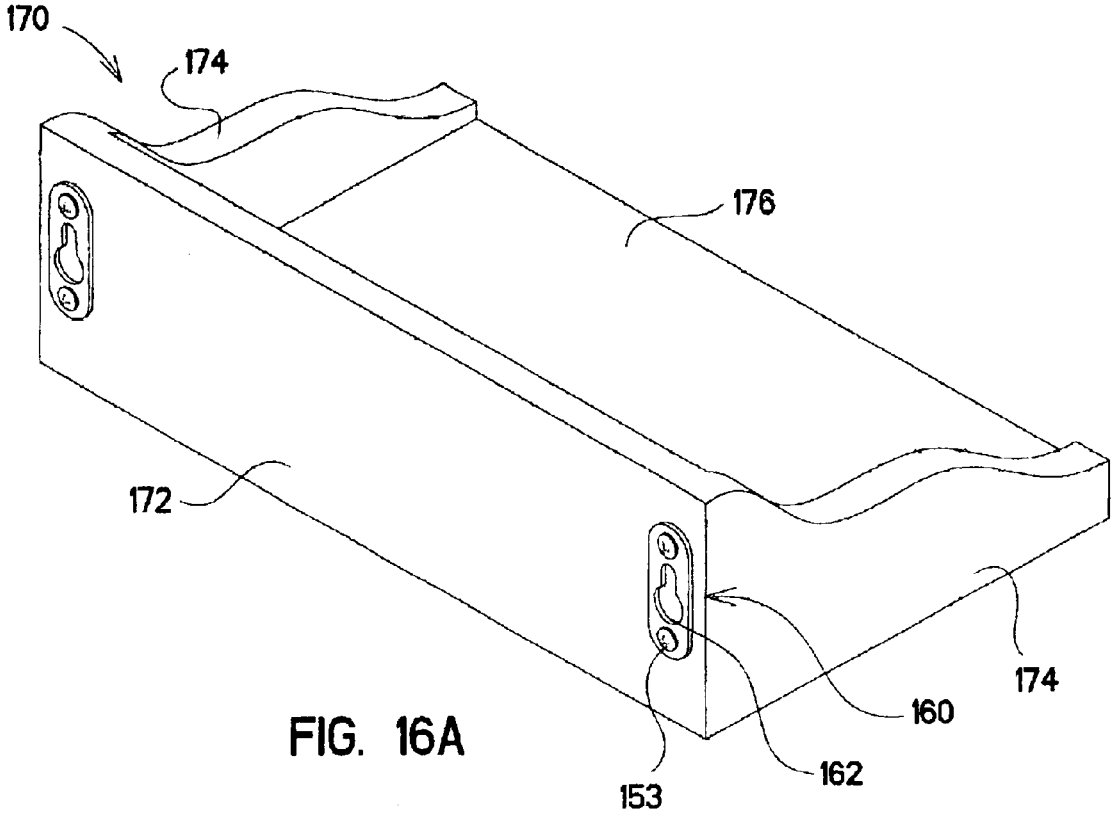
FIG. 16A is a view in perspective of an exemplary shelf with keyhole type hangers.
Figure 16B:
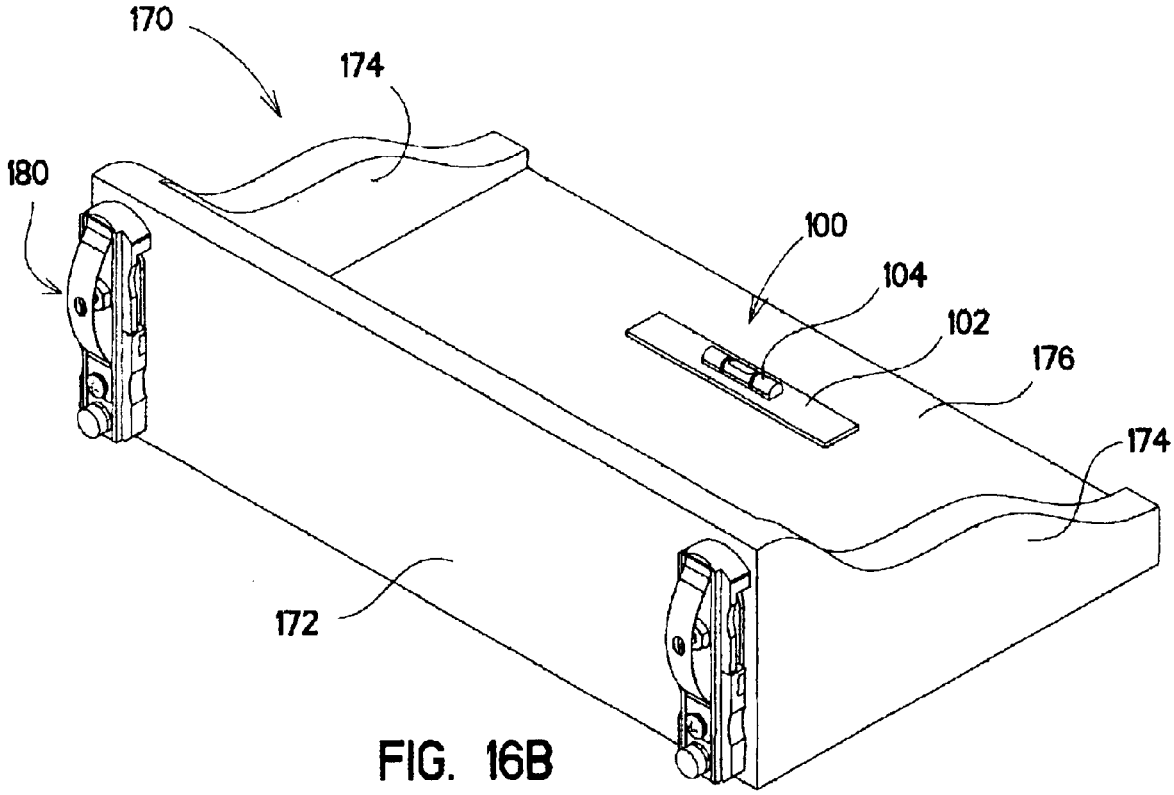
FIG. 16B is a view in perspective of the exemplary shelf of FIG. 16A with the adjustable or universal marking devices of FIG. 15B mounted on shelf keyhole type hangers and the level device placed on a shelf plane or surface.
Figure 17:
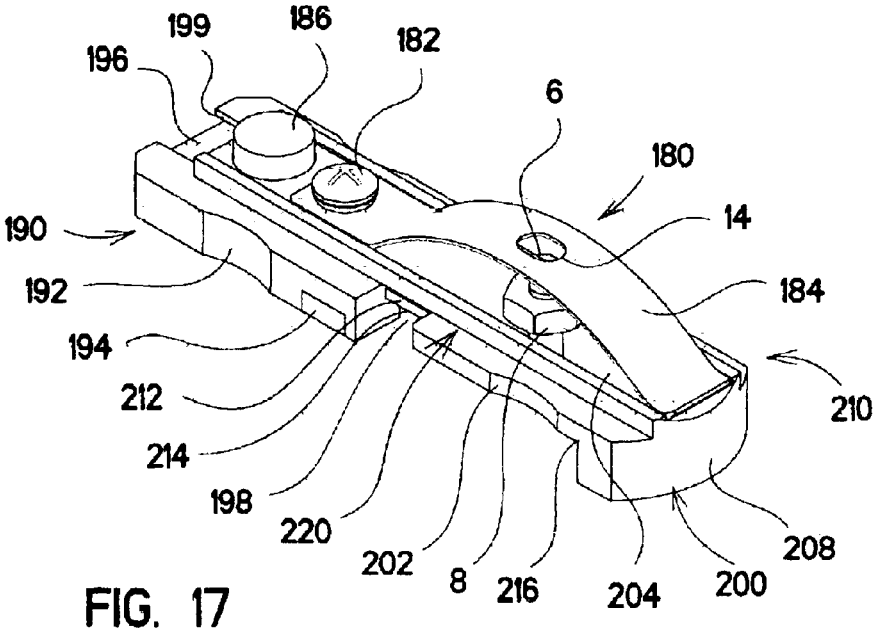
FIG. 17 is a view in perspective of the adjustable or universal marking device of FIG. 15B.

The adjustable locators may further be employed to mount a shelf as illustrated in FIGS. 16A–16B. Specifically, shelf 170 includes a rear wall 172, side walls 174 and a bottom wall 176. The rear wall includes keyhole hangers 160 each secured to the rear wall via fasteners 153 (e.g., screws, etc.) and disposed toward a respective side wall. The hangers each include a keyhole aperture 162 to engage fasteners on the wall to suspend the shelf.

An adjustable or universal locator according to the present invention is illustrated in FIGS. 17 and 18A–18D. Specifically, adjustable locator 180 includes a base 190 and a marking assembly 200. The marking assembly is in slidable relation with the base to accommodate various mounting hardware or mechanisms. Base 190 is generally rectangular with truncated rear comers. The base lower surface includes a substantially rectangular groove 198 defined therein to receive fasteners 153 (securing hangers to frame 90) when the locator is mounted on that hanger. The base top surface similarly includes a groove 196 defined therein, where the groove side walls include a ledge or overhang 199. Ledges 199 slidably engage the marking assembly as described below to facilitate adjustment of the universal locator for various types of mounting hardware. The base side walls each include an indentation 192 to enhance gripping of the base by a user to manipulate the universal locator. Magnets 194 are each disposed toward an upper front comer section of the base to releasably secure the universal locator to a frame hanger or other mounting hardware. Rubber material or other elastomer coating 280 may be disposed along the base member bottom surface toward the side edges to enhance engagement of the frame hanger by the base.

Marking assembly 200 includes engagement section 210 and a marking section 220. Engagement section 210 includes a base engagement section 214 and a hanger engagement section 216. Base section 214 is substantially rectangular and is slidably inserted in base 190. Channels 212 are defined in the marking assembly side walls between base section 214 and marking section 220 to receive ledges 199 of base 190. Hanger section 216 is generally rectangular with a rounded front edge and extends from the base section distal edge. A ledge 208 extends downward from the hanger section front edge to support the locator during marking. The ledge includes a rubber material or other elastomer coating 282 disposed on the ledge bottom surface to compensate for various heights (e.g., thickness) of frame mounting hardware and to create additional support for the locator on the frame surface. The hanger section side walls each include an indentation 202 to enhance gripping of that section by a user. A substantially cylindrical post 206 extends down from a generally central location of hanger section 216 to engage article mounting hardware (FIGS. 18C–18D) as described below.

Marking section 220 is attached to or integral with the top surface of engagement section 210. The marking section is substantially rectangular and includes marking member 6, securing mechanism 186 and resilient member 184. The marking member is substantially similar to the marking members described above and is attached to the marking section at an intermediate location. The marking member is typically in the form of a threaded pin or spike that is disposed through opening 22 defined in the marking section. However, the marking member may be implemented by any type of marking implement or instrument (e.g., pen, pencil, marker, etc.). Fastener 8, preferably in the form of a nut, secures the marking member position, while the threaded engagement of the marking member enables adjustment of the marking member height relative to the base. The marking member is preferably integral with post 206, where the post is disposed through the engagement and marking sections. The post engages the article mounting hardware (e.g., FIGS. 18C–18D; the apex of hanger ring 154 or hanger aperture 162) and further supports the locator when pressure is applied during marking. Resilient member 184 is in the form of a strip, preferably constructed of metal, in a curved or arched configuration to cover the marking member. One end of the resilient member is attached to a longitudinal end of marking section 220 via a fastener 182 (e.g., screw, rivet, etc.). Resilient member 184 includes opening or aperture 14 defined therein toward the member apex and substantially coincident the marking member to permit the marking member to protrude through the resilient member and mark the supporting surface when sufficient pressure is applied. The resilient member preferably includes a covering (e.g., felt, rubber, foam, plastic, etc.) to enable the article (e.g., frame or shelf) to be manipulated on the support surface to a desired location without leaving marks (e.g., scratches, etc.).

A groove 204 is defined in marking section 220 and extends between the section longitudinal ends. The resilient member is generally disposed within the groove, where the groove basically serves as a guide for motion of the unsecured resilient member end when the resilient member compresses or bends inward in response to pressure applied to the frame. Securing mechanism 186 is disposed on the marking section adjacent fastener 182 and serves to secure the marking assembly in a fixed position relative to the base. Mechanism 186 is preferably implemented in the form of a thumbscrew.

Figure 18A:
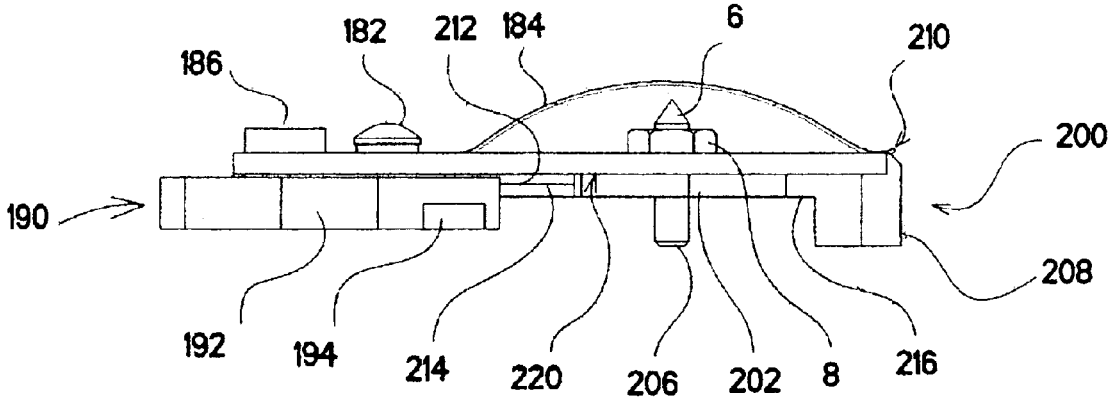
FIG. 18A is a side view in perspective of the adjustable marking device of FIG. 17.
Figure 18B:
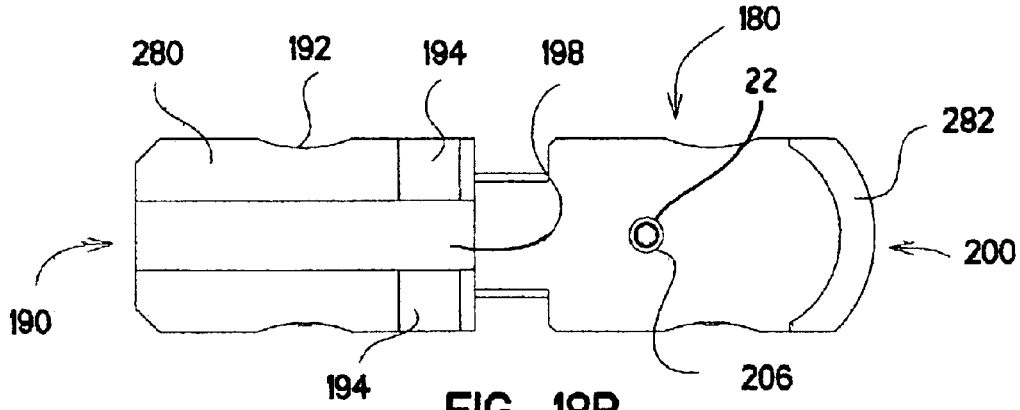
FIG. 18B is a bottom view in plan of the adjustable marking device of FIG. 17.
Figure 18C:
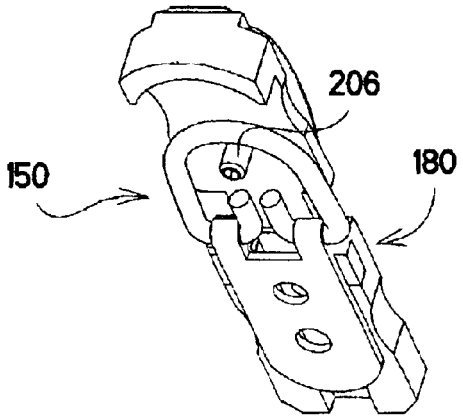
FIG. 18C is a view in perspective of the adjustable marking device of FIG. 17 engaging a ring type or strap hanger.
Figure 18D:
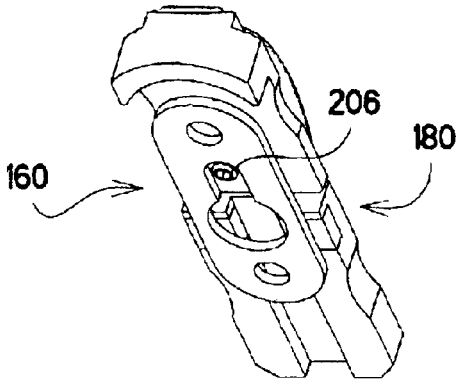
FIG. 18D is a view in perspective of the adjustable marking device of FIG. 17 engaging a keyhole type hanger.

Operation of the universal locator is described with reference to FIGS. 15A, 15B, 16A, 16B, 17 and 18A–18D. Initially, the locators are releasably mounted on the hangers of an article (e.g., frame, shelf, etc.). Base 190 is placed along the hanger metal foundation and forced forward against the hanger ring housing with magnets 194 contacting the hanger base through coating 280 and particular hanger fasteners 153 residing within groove 198. Marking assembly 200 is manipulated to extend from the base, where post 206 engages the hanger ring apex (FIG. 18C) and pushes the ring upward. With respect to keyhole hanger 160, marking assembly 200 is manipulated to extend from the base, where post 206 engages the uppermost portion of keyhole aperture 162 (FIG. 18D). The locator is typically configured to accommodate the keyhole hanger in a fully compressed state (e.g., where the marking assembly is positioned proximate the base). Once the marking assembly attains an appropriate position, mechanism 186 is utilized to lock the marking assembly in the desired position and secure the locator to the hanger. Level device 100 may be placed on the article horizontal surfaces or planes for preparatory manipulations.

The article (e.g., frame, shelf, etc.) is positioned adjacent the supporting surface, where the resilient members of the locators contact the supporting surface. The article is manipulated along the support surface to a desired location, where the resilient members prevent corresponding locator marking members from contacting that surface during this positioning. When the article position on a support surface has been established, the level device is examined, where the article position is adjusted as needed. Manual pressure is applied to the article and directed toward the support surface in the vicinity of the universal locators. The article together with the locators starts moving toward the support surface overcoming the elasticity of the resilient members. The marking members protrude through the corresponding apertures of the resilient members, thereby providing marks and/or imprints on the support surface. The universal locators may be utilized for mounting picture frames, mirrors, shelves, cornices, bed headboards and the like outfitted with ring or keyhole hangers with a ring or aperture of any shapes and sizes.

The various locators of the present invention mark fastener positions on a support surface with enhanced precision. This precision enables various schemes for securely hanging articles on the support surface. For example, a typical security installation requires slotted brackets (e.g., two upper brackets and one or more lower bracket) on an article as described above for FIGS. 7A–7B. However, the adjustable or application specific locators enable the article to be securely installed without the upper brackets. The upper brackets are required to engage 'S'-shaped brackets attached to the support surface. The 'S'-shaped brackets permit vertical and horizontal adjustment of the article to align the lower bracket with a 'T'-screw for creating a locking mechanism. The accuracy of the present invention locators basically eliminates this adjustment, thereby enabling a secure installation with existing article mounting hardware and one or more lower slotted brackets for 'T'-screw engagement.

Figure 19A:
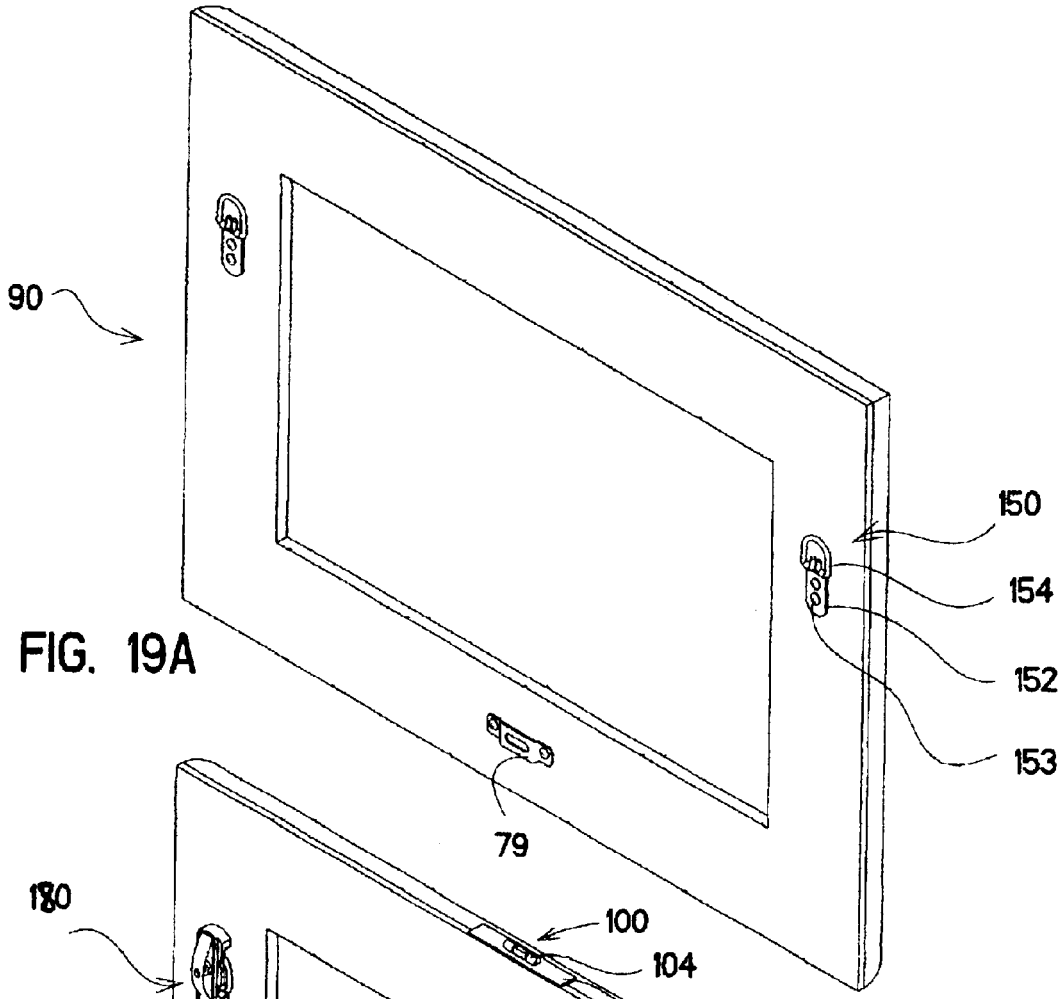
FIG. 19A is a view in perspective of an exemplary picture frame with ring type hangers and a security bracket for an alternative security installation according to the present invention.
Figure 19B:
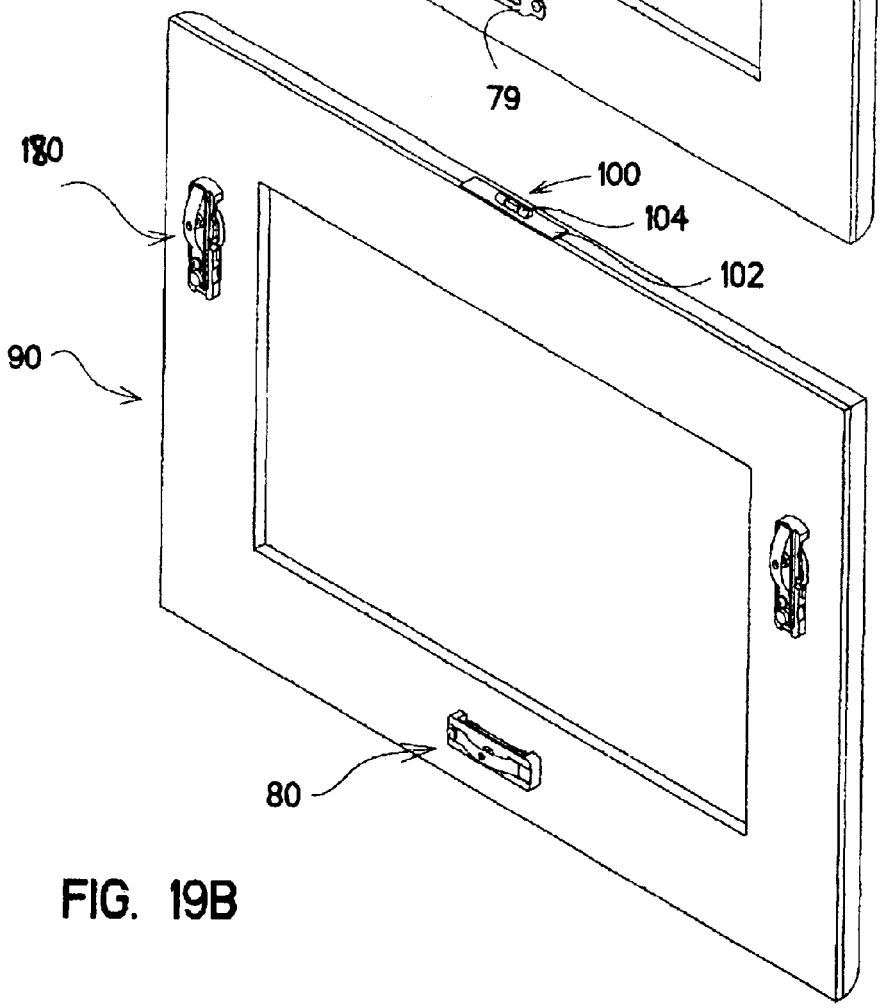
FIG. 19B is a view in perspective of the exemplary picture frame of FIG. 19A with the marking devices of FIG. 17 mounted on the frame hangers and the marking device of FIG. 10A mounted on a security bracket and the present invention level device placed on a frame plane or surface.

An exemplary security scheme is illustrated in FIGS. 19A–19B. Specifically, frame 90 includes ring type hangers 150 disposed on an upper frame portion toward opposing upper comers. In order to securely hang the frame on a support surface, a single slotted bracket 79 is disposed on the frame lower portion to engage a corresponding 'T'-screw. The frame, ring type hangers and slotted brackets are substantially similar to those described above. An adjustable locator 180 is disposed on each hanger 150, while a lower locator 80 is disposed on bracket 79. The locators are substantially similar to and disposed on article mounting hardware in substantially the same manner as the corresponding locators described above. The locators place marks on the support surface for installation of fasteners (e.g., conventional headed screws and 'T'-screw). Since the locators provide enhanced accuracy, the lower bracket is aligned with a corresponding 'T'-screw without adjustment. The present invention locators may utilize existing article mounting hardware (e.g., ring hangers, keyhole hangers, etc.) and a slotted bracket serving as a locking mechanism component to implement a security installation.

Figure 20A:
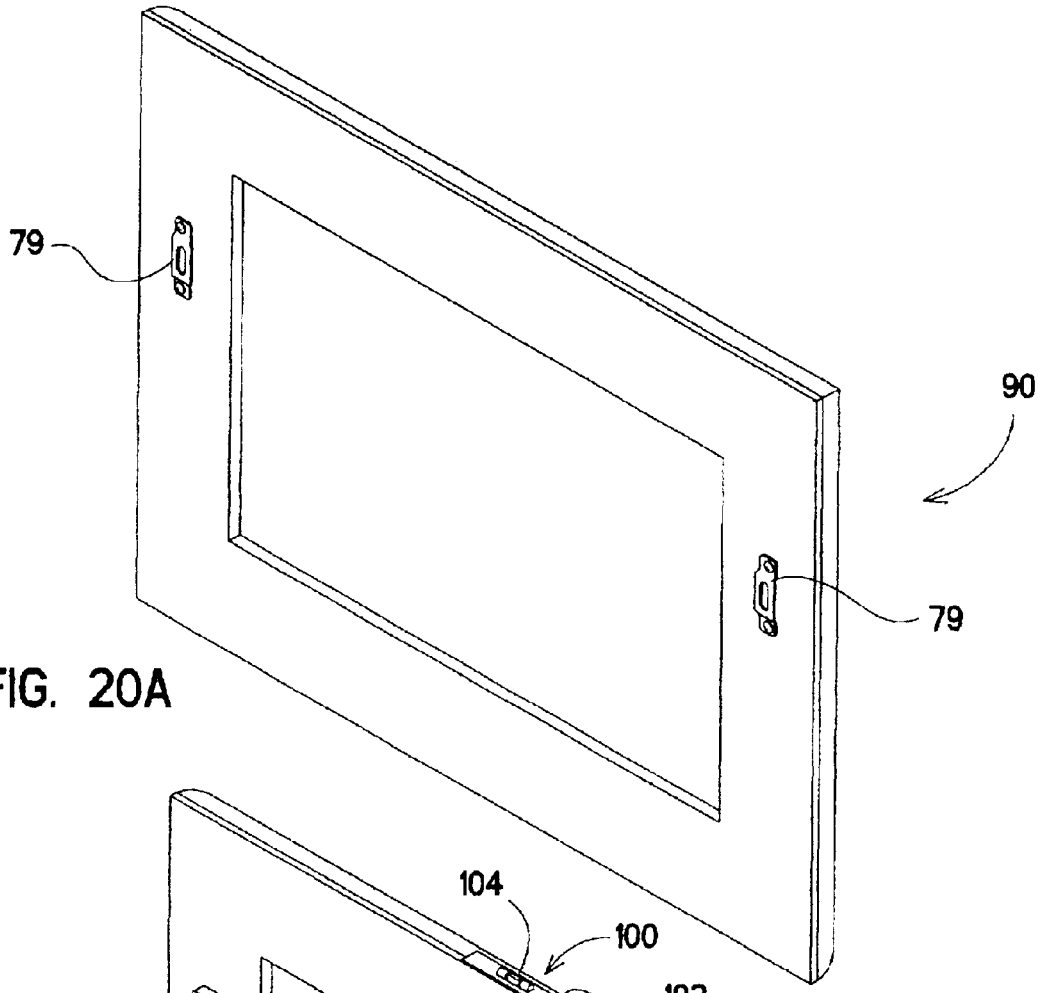
FIG. 20A is a view in perspective of an exemplary picture frame with security brackets for another alternative security installation according to the present invention.
Figure 20B:
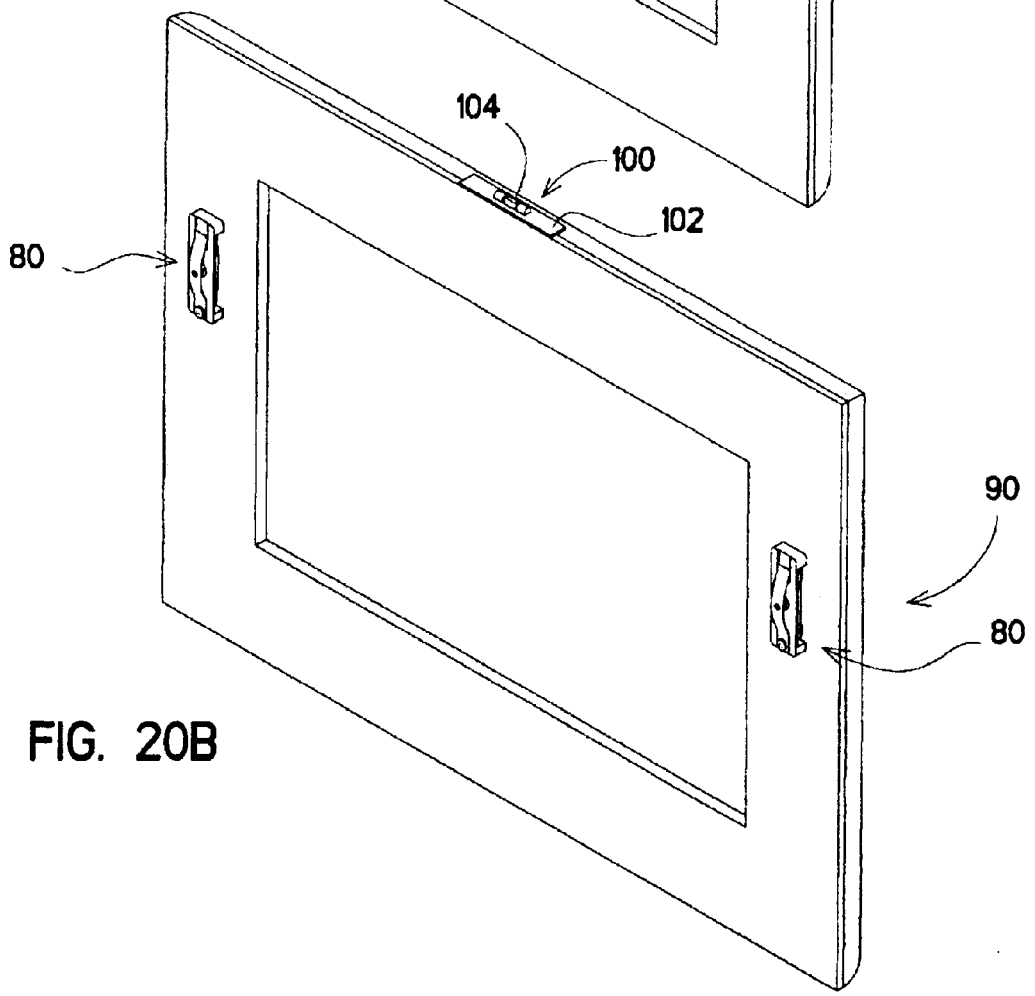
FIG. 20B is a view in perspective of the exemplary picture frame of FIG. 20A with the marking device of FIG. 10A mounted on the frame security brackets and the present invention level device placed on a frame plane or surface.

Another exemplary security scheme is illustrated in FIGS. 20A–20B. Specifically, frame 90 includes slotted brackets 79 disposed on an upper frame portion toward opposing frame comers. The brackets each engage a corresponding 'T'-screw on a support surface. The frame and slotted brackets are substantially similar to those described above. Locator 80 is disposed on each slotted bracket. The locators are substantially similar to and mounted on the brackets in substantially the same manner as the corresponding locators described above. The locators place marks on the support surface for installation of 'T'-screws, where the marks indicate locations for the 'T'-screws that are in alignment with the slotted brackets. In this case, the slotted brackets and 'T'-screws serve as hanging hardware and locking mechanisms.

Figure 21A:
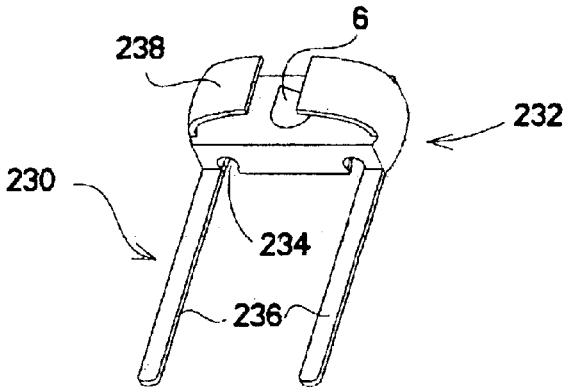
FIG. 21A is a view in perspective of an application specific marking device for a ring type or strap hanger according to the present invention.
Figure 21B:
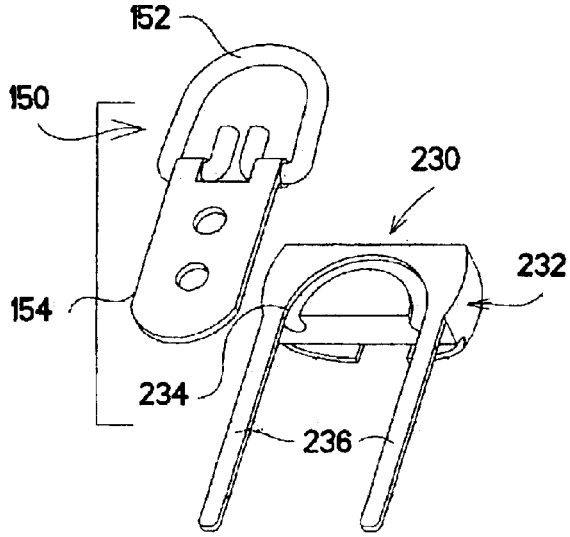
FIG. 21B is an exploded view in perspective of the marking device of FIG. 21A mounted on the ring type hanger.

Locators for the strap and keyhole hangers may be application or mounting hardware specific as described above and may be manufactured from a single block of material (e.g., without any subsequent assemblies), such as plastic or other materials, by injection molding, extrusion, or other processes. The locators may include various configurations (e.g., of the resilient member, of marking member location, etc.) depending upon a particular application, support surface fasteners (e.g., nail, screw or hook of proper dimensions, etc.), article weight or support surface material as described above. These locators may be disposable and may be predisposed on article mounting hardware before the article is purchased or otherwise obtained as described above. An exemplary hardware specific locator for the 'D'-ring type hanger and a screw type wall fastener is illustrated in FIGS. 21A–21B. Specifically, hardware specific locator 230 includes a base 232, marking member 6 attached to the base and resilient members 238. The base is generally rectangular and includes marking member 6 disposed thereon at a generally central location. The marking member is generally disposed on base 232 at a location that corresponds to the upper portion of the 'D'-ring (e.g., or other appropriate location depending upon the support surface fastener). The marking member is substantially similar to the marking member of the hardware specific locators described above and may be in the form of a pin or spike. However, the marking member may be implemented by any type of marking implement or instrument (e.g., pen, pencil, marker, etc.).

Resilient members 238 are generally in the form of generally rectangular projections extending from the side edges of the base and curving inward toward marking member 6. The resilient members extend above the base for a distance greater than the height of the marking member as described above. The area above marking member 6 is open to enable the marking member to protrude beyond the resilient members and mark the wall in response to applied pressure as described below. The resilient members are typically constructed of materials that enable the article (e.g., frame, shelf, etc.) to be manipulated on the support surface to a desired location without leaving marks (e.g., scratches, etc.). However, the resilient members may include a covering (e.g., felt, rubber, foam, plastic, etc.) to further prevent inadvertent marking of the wall during article positioning. The rear surface of the base includes a curved channel 234 configured to accommodate 'D'-ring 152 of bracket 150 (FIG. 15A). The channel dimensions are slightly less than those of the 'D'-ring to provide a snug or snap-fit engagement. Rods 236 are substantially rectangular and extend down from the lower edge of base 232 adjacent the base side edges. The rods basically surround the 'D'-ring and base of the hanger to maintain stability of the locator on the hanger.

In operation, locators 230 are placed over the 'D'-ring hangers of an article (e.g., frame, shelf, etc.) with 'D'-ring 152 inserted within channel 234. The article is placed adjacent the wall or other supporting surface with resilient members 238 contacting the surface. The article is manipulated along the surface, where the resilient members prevent the marking member from contacting that surface. When a desired location is found, pressure is applied to the article to bend the resilient members inward and enable the marking members to extend beyond the bent resilient members and place a mark on the wall.

Figure 22A:
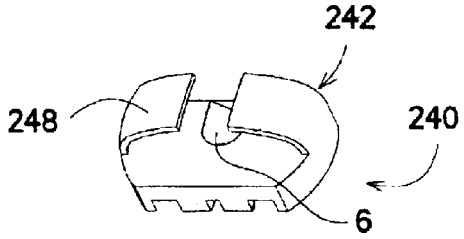
FIG. 22A is a view in perspective of an application specific marking device for a keyhole type hanger according to the present invention.
Figure 22B:
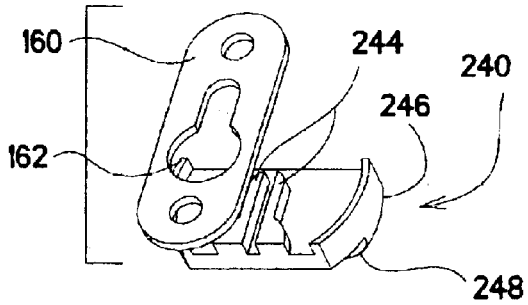
FIG. 22B is an exploded view in perspective of the marking device of FIG. 22A mounted on the keyhole type hanger.

An exemplary hardware specific locator for keyhole type hangers with keyhole apertures is illustrated in FIGS. 22A–22B. Specifically, hardware specific locator 240 includes a base 242, marking member 6 and resilient members 248. The base is generally rectangular with curved shorter dimensioned side edges. Ledges 246 extend downward from the base side edges. Marking member 6 is disposed on the base at a generally central location toward the base upper edge. The marking member is generally disposed on base 242 at a location that corresponds to the upper portion of the hanger keyhole aperture. The marking member is substantially similar to the marking member of the hardware specific locators described above and may be in the form of a pin or spike. However, the marking member may be implemented by any marking implement or instrument (e.g., pen, pencil, marker, etc.).

Resilient members 248 are in the form of substantially rectangular projections extending from the side edges of the base and curving inward toward marking member 6. The resilient members extend above the base for a distance greater than the height of the marking member as described above. The area above marking member 6 is open to enable the marking member to protrude beyond the resilient members and mark the wall in response to applied pressure as described below. The resilient members are typically constructed of materials that enable the article (e.g., frame, etc.) to be manipulated on the support surface to a desired location without leaving marks (e.g., scratches, etc.). However, the resilient member may include a covering (e.g., felt, rubber, foam, plastic, etc.) to further prevent inadvertent marking of the wall during article positioning. The rear surface of the base includes posts 244 that collectively contour the shape of keyhole aperture 162 of hanger 160. The posts are generally symmetrical and are separated from each other by a slight distance to facilitate snug insertion or a snap fit engagement with the keyhole aperture of bracket 160.

The marking procedure is substantially the same as that described above for the hardware specific locators, where the hardware specific locators may be discarded or re-used (e.g., a limited quantity of times) after marking. In operation, locators 240 are disposed on hangers 160 of an article (e.g., frame, shelf, etc.), where posts 244 are snugly inserted within aperture 162. The article is positioned adjacent the wall or other support surface with resilient members 248 contacting that surface. The article is manipulated along the surface, where resilient members 248 prevent the marking member from contacting that surface. When a desired location is found, pressure is applied to the article to bend the resilient members inward and enable the marking members to extend beyond the bent resilient members to place a mark on the wall.

Figure 23:
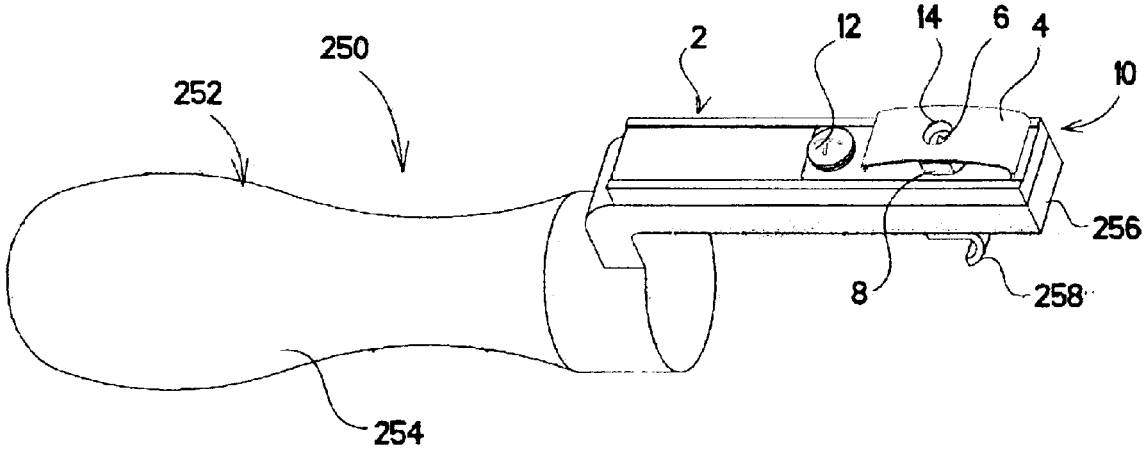
FIG. 23 is a view in perspective of an article mounting mechanism including a marking device to place marks on a supporting surface for placement of fasteners that engage an article suspension wire according to the present invention.

The present invention may be in the form of a hand held marker that allows visual evaluation of the location of a mark without the risk of incidentally damaging the surface during preparatory manipulations as illustrated in FIG. 23. This device typically produces marks for articles that are suspended on a support surface or wall via a wire or cord. Specifically, device 250 includes a handle 252 and marking device 10. The marking device is substantially similar to the marking device described above for FIG. 1. Handle 252 includes a proximal gripping section 254 and a marking device platform 256 attached thereto. Grip portion 254 is contoured for enhanced gripping by a user. Platform 256 is generally 'L'-shaped to offset the handle from the wall and provide space for a user hand. Platform 256 initially extends transversely and then longitudinally from a distal end of gripping section 254. The platform is substantially rectangular, where the longitudinal platform section includes marking device 10 secured thereto. The handle may further include a level to ensure proper orientation of the article on the wall or support surface. The opposing surface of platform 256 includes a hook (e.g., picture hanger, etc.) 258 with a hook aperture for receiving a fastener (e.g., nail or screw) disposed substantially coincident marking member 6. The hook receives a suspension wire of an article in order to suspend the article from device 250.

In operation, an article suspension wire is placed on hook 258 and the user engages gripping portion 254 to place device 250 with the article adjacent a wall or other supporting surface with resilient member 4 contacting that surface. Device 250 may be manipulated along the surface to a desired article location, where resilient member 4 prevents marking member 6 from contacting that surface during this positioning. The level may be examined and the article may be adjusted as needed. When a desired location is found, pressure is applied to handle 254 (or the article) to bend resilient member 4 inward and enable the marking member to protrude through the resilient member aperture and place a mark on the support surface.

Figure 24:
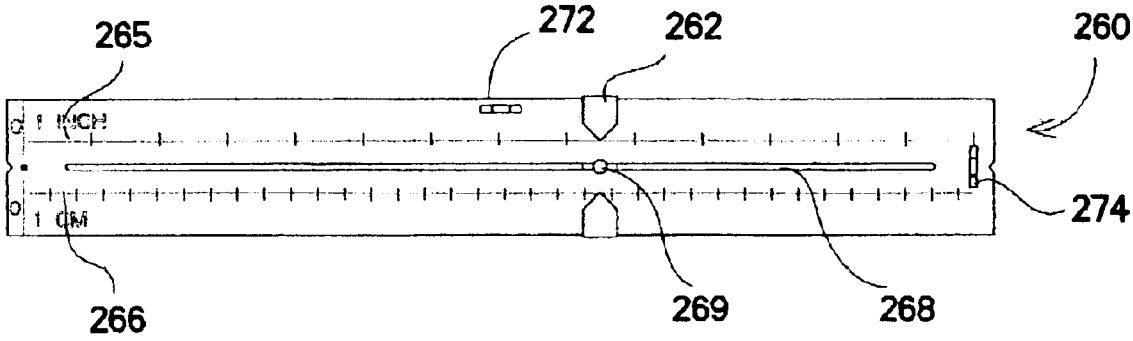
FIG. 24 is a top view in plan of a measuring instrument employing marking devices according to the present invention.
Figure 25:
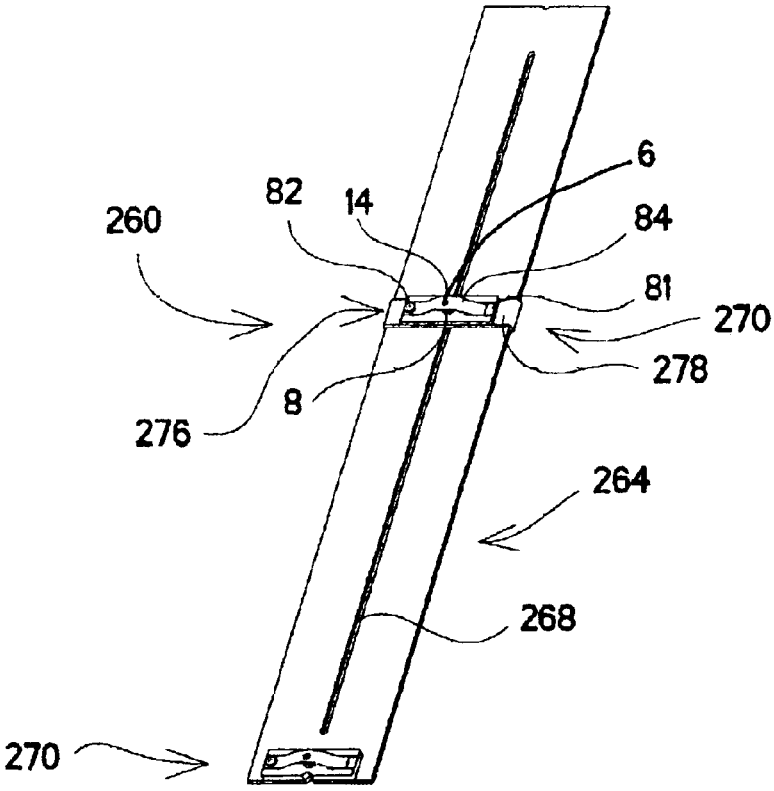
FIG. 25 is a view in perspective of the rear surface of the measuring instrument of FIG. 24.

A measurement transfer instrument according to the present invention to provide marks indicating measurements on a support surface is illustrated in FIGS. 24–25. Specifically, instrument 260 includes a measurement member 264 and marking devices 270. The measurement member is substantially rectangular and includes scales 265, 266 imprinted or otherwise disposed thereon to provide various measurements (e.g., distance, angular position, etc.). Scales 265, 266 may be in any desired units or systems (e.g., distance, angles, metric, British or Imperial System, etc.). By way of example only, measuring member 264 provides distance measurements, where scale 265 indicates British or Imperial System units (e.g., inches) and scale 266 indicates metric system units (e.g., centimeters). Measuring member 264 includes a generally elliptical slot 268 defined therein. The slot extends between the measuring member longitudinal ends along scales 265, 266. The rear surface of the measuring member includes marking devices 270. Marking devices 270 are similar to lower locator or marking device 80 described above. The marking devices each include a substantially rectangular base 272, marking member 6 and resilient member 84. The marking and resilient members are as described above. One marking device 270 is secured to an end of the measuring member adjacent initial values of the scale. Another marking device 270 is attached to a runner 276. The runner includes a substantially rectangular platform 278 for receiving the marking device and a securing mechanism 269 extending from the runner rear surface through the longitudinal slot to secure the marking device to the measuring member in slidable relation. Thus, the fixed marking device 270 indicates an initial point, while sliding marking device 270 may be manipulated along the measuring member to a location that indicates a precise distance. The securing mechanism is generally in the form of a thumbscrew to secure the marking device to the runner and to maintain the sliding marking device at a fixed location to represent a particular measurement. The runner further includes indicators 262 respectively extending from the top and bottom edges of the runner platform. The indicators extend from the runner platform on the instrument rear surface over the instrument top and bottom edges to the instrument front surface to indicate the marking device position along the measuring member scales. Indicators 262 are generally triangular to precisely indicate a measurement on the measuring member. The measuring member may further include bubble levels 272, 274 to ensure proper orientation in horizontal and vertical directions, respectively.

In operation, the runner is manipulated to a desired position along measuring member 264 at a desired distance from the fixed or reference marking device. Securing mechanism 269 is manipulated to lock the runner and corresponding marking device in a desired position. The instrument is positioned adjacent the surface to be marked, where the resilient members of the marking devices are in contact with the surface. The instrument may be manipulated along the surface, where the resilient members prevent the marking members from contacting that surface during instrument positioning. When a desired location is found and a desired measurement is set on one of the measuring member scales, pressure is applied to the instrument to bend the resilient members inward and enable the marking members to protrude through resilient member apertures to mark the surface at desired locations. The marks produced by the instrument are a particular distance apart and represent a particular measurement or distance.

It will be appreciated that the embodiments described above and illustrated in the drawings represent only a few of the many ways of implementing a marking device and method for indicating locations on a support structure for fastener placement and measurement.

The marking devices may be of any shape or size and may be constructed of any suitable materials. The devices may be configured or adjusted for use with any type of handle, support structure, article weight and configuration, article mounting fastener or hardware (e.g., saw-tooth bracket, slotted bracket, ring hanger, hanger with any aperture, etc.) or support surface fastener (e.g., nail, screw, hook, 'S'-shaped bracket, etc.) arranged or combined in any fashion. The devices may be utilized with any type of article (e.g., frame, shelf, mirror, etc.) and may place any type of mark (e.g., hole, indentation, pen, pencil, marker, etc.) on any support surface or structure. Pressure may be applied to the marking device or article at any desired location to place a mark on a surface. The marking devices may include any type of magnets, adhesives, snap-fit configurations or other securing devices disposed at any locations to permanently or removably secure the marking devices to a handle or article.

The resilient member may be of any quantity, shape or size, may be disposed at any suitable location and may be constructed of any suitably resilient materials (e.g., metal, plastic, rubber, foam, etc.) or structures providing resiliency. The resilient member strip bend may be disposed at any location and have an overlapped portion of any size. The resilient member ring may be of any shape or size, may be disposed at any location and may be constructed of any resilient materials (e.g., rubber, foam, etc.). The resilient member housing and bias member may be of any shape or size. The housing may be constructed of any suitable materials with the open portion at any location and of any quantity, shape or size. The bias member plate and raised portion may be of any shape or size and may be biased by any type of bias mechanism (e.g., spring, resilient strip, etc.). The resilient member dome may be of any shape or size, may be disposed at any location and may be constructed of any desired materials. The dome may be biased by any type of bias mechanism (e.g., spring, resilient strip, etc.). The dome channel may be of any shape or size and disposed at any location. The resilient member strip may be of any shape or size, may include any type of curved or other configuration (e.g., sinusoid, waves, bent, etc.) and may be constructed of any suitable materials (e.g., metal, plastic, rubber, etc.). Any portion of the strip may be fastened to the marking device at any location via any quantity of any conventional or other fastener (e.g., screw, rivet, etc.). The resilient members may include any quantity of any type of covering (e.g., felt, rubber, foam, plastic, etc.) disposed on any portion or at any location on the resilient member. The resilient member aperture may be of any quantity, shape or size and may be disposed at any location.

The marking member may be implemented by any type of marking implement or instrument (e.g., pin, spike, pen, pencil, marker, etc.) and may be disposed at any location. The marking member may be secured to the marking device via any conventional or other securing mechanisms (e.g., threaded engagement, nut, welded, etc.). The height of the marking member may be adjusted on any of the marking devices described above via any conventional or other techniques (e.g., threaded engagement, etc.). The marking member may be constructed of any suitable materials (e.g., metal, plastic, etc.).

The audible indicator may be of any quantity, shape or size and may be disposed at any location on the audible marking device. The indicator may be implemented by any conventional or other audio indicator (e.g., electrical, mechanical, etc.) and provide any audio signal (e.g., click, beep, buzz, etc.). The audible indicator may include any quantity of any type of conventional or other actuator (e.g., switch, button, etc.). The audible device base may be of any shape or size, and include any quantity of slots of any shape or size. The audible indicator may be secured to the marking device via any conventional or other fastening techniques (e.g., screw, etc.). The groove may be defined in the marking device base at any location and may be of any quantity, shape or size. The resilient member may be of any quantity, shape or size, may include any type of curved or other configuration (e.g., sinusoid, waves, bent, etc.) and may be constructed of any suitable materials (e.g., metal, plastic, rubber, etc.). Any portion of the strip may be fastened to the marking device at any location via any quantity of any conventional or other fastener (e.g., screw, rivet, etc.). The resilient member may include any quantity of any type of covering (e.g., felt, rubber, foam, plastic, etc.) disposed on any portion or at any location on the resilient member. The resilient member aperture may be of any quantity, shape or size and may be disposed at any location. The marking member may be implemented by any type of marking implement or instrument (e.g., pin, spike, pen, pencil, marker, etc.) and may be disposed at any location. The marking member may be secured to the marking device via any conventional or other securing mechanisms (e.g., threaded engagement, nut, welded, etc.). The height of the marking member may be adjusted via any conventional or other techniques (e.g., threaded engagement, etc.). The marking member may be constructed of any suitable materials (e.g., metal, plastic, etc.).

The switching device may be of any quantity, shape or size and may be disposed at any location on the marking device. The switch may be implemented by any conventional or other switch (e.g., momentary, electrical, mechanical, etc.). The switch may energize any quantity of any conventional or other audio or visual indicator (e.g., light, beeper, buzzer, clicker, voice synthesis, etc.). The switch may include any quantity of any type of conventional or other actuator (e.g., switch, button, etc.). The switching device base may be of any shape or size, and include any quantity of slots of any shape or size. The switching device may be secured to the marking device via any conventional or other fastening techniques (e.g., screw, etc.). The switch may include any quantity of terminals of any shape or size disposed at any locations, and may include any appropriate circuitry to provide the appropriate signal to an indicator. The groove may be defined in the marking device base at any location and may be of any quantity, shape or size. The resilient member may be of any quantity, shape or size, may include any type of curved or other configuration (e.g., sinusoid, waves, bent, etc.) and may be constructed of any suitable materials (e.g., metal, plastic, rubber, etc.). Any portion of the strip may be fastened to the marking device at any location via any quantity of any conventional or other fastener (e.g., screw, rivet, etc.). The resilient member may include any quantity of any type of covering (e.g., felt, rubber, foam, plastic, etc.) disposed on any portion or at any location on the resilient member. The resilient member aperture may be of any quantity, shape or size and may be disposed at any location. The marking member may be implemented by any type of marking implement or instrument (e.g., pin, spike, pen, pencil, marker, etc.) and may be disposed at any location. The marking member may be secured to the marking device via any conventional or other securing mechanisms (e.g., threaded engagement, nut, welded, etc.). The height of the marking member may be adjusted via any conventional or other techniques (e.g., threaded engagement, etc.). The marking member may be constructed of any suitable materials (e.g., metal, plastic, etc.).

The upper and lower locators may be of any shape or size and may be disposed at any locations. The locators may include any offset between the marking member and post to identify appropriate locations for fasteners. The locator components (e.g., base, resilient member, post, etc.) may be of any shape or size and constructed of any materials. The resilient member may be of any quantity, shape or size, may include any type of curved or other configuration (e.g., sinusoid, waves, bent, etc.) and may be constructed of any suitable materials (e.g., metal, plastic, rubber, etc.). Any portion of the strip may be fastened to the marking device at any location via any quantity of any conventional or other fastener (e.g., screw, rivet, etc.). The resilient member may include any quantity of any type of covering (e.g., felt, rubber, foam, plastic, etc.) disposed on any portion or at any location on the resilient member. The resilient member aperture may be of any quantity, shape or size and may be disposed at any location. The groove may be defined in the marking device base at any location and may be of any quantity, shape or size. The marking member may be implemented by any type of marking implement or instrument (e.g., pin, spike, pen, pencil, marker, etc.) and may be disposed at any location. The marking member may be secured to the marking device via any conventional or other securing mechanisms (e.g., threaded engagement, nut, welded, etc.). The height of the marking member may be adjusted via any conventional or other techniques (e.g., threaded engagement, etc.). The marking member may be constructed of any suitable materials (e.g., metal, plastic, etc.). The post, recessed portion and windows may be of any shape or size and disposed at any location on the locators. The post may be of any quantity and/or configuration to mount any type of article mounting hardware (e.g., bracket). The magnetic strip may be implemented by any magnetic material or adhesive and may be of any shape or size and disposed at any suitable location on the locators.

The hardware specific locators may be of any shape or size and may be constructed of any suitable materials (e.g., metal, plastic, etc.). The hardware specific locators may include any quantity of posts, grooves, channels or other structures of any shape or size and configured and/or arranged (e.g., any distance apart, any order, etc.) in any manner to engage any type of article mounting hardware (e.g., slotted bracket, ring hanger, hanger with aperture, etc.). The hardware specific locators may include any offset between the marking member and engaging member structure (e.g., posts, groove, etc.) to identify appropriate locations for support surface fasteners (e.g., nail, screw, hook, etc.). The hardware specific locators may include any quantity of resilient members of any shape or size arranged in any desired configuration and constructed of any suitable materials. The hardware specific locators may be used once or any amount of times. The resilient member projections may be of any quantity, shape or size and may be spaced apart or arranged about the base in any fashion. The channel for receiving a ring may be of any shape or size and may be disposed at any location. The rods may be of any shape or size and disposed at any location to encompass article mounting hardware or other object.

The adjustable or universal locator may be of any shape or size and constructed of any suitable materials. The base and marking assembly may employ any conventional or other techniques to attain a slidable relation (e.g., grooves, rails, rollers, etc.). The base lower groove may be of any size or shape to accommodate article fasteners and may be disposed at any location. The base upper groove and overhangs may be of any quantity, shape or size and may be disposed at any location. The indentations may be of any quantity, shape or size and may be disposed at any locations on the base and marking assembly. The magnets may be of any quantity, shape or size, may be disposed at any location on the base and may be constructed of any magnetic material. The base may further include any type of coating to enhance engagement of an article fastener. The engagement, marking, base engagement and hanger engagement sections may be of any quantity, shape, size or configuration, while the marking or other sections of the marking assembly may include any quantity of channels of any shape or size disposed at any location to engage the base. The hanger section front ledge may be of any quantity, shape or size and may be covered with any material (e.g., rubber, etc.). The hanger section post may be of any quantity, shape or size to engage a hanger ring or aperture, where the post may be at any location and may be constructed of any materials. The hanger section post may be an integral part of the marking member or a separate member housed in the marking section. The resilient member may be of any quantity, shape or size, may include any type of curved or other configuration (e.g., sinusoid, waves, bent, etc.) and may be constructed of any suitable materials (e.g., metal, plastic, rubber, etc.). Any portion of the strip may be fastened to the marking device at any location via any quantity of any conventional or other fastener (e.g., screw, rivet, etc.). The resilient member may include any quantity of any type of covering (e.g., felt, rubber, foam, plastic, etc.) disposed on any portion or at any location on the resilient member. The resilient member aperture may be of any quantity, shape or size and may be disposed at any location. The groove may be defined in the marking section at any location and may be of any quantity, shape or size. The marking member may be implemented by any type of marking implement or instrument (e.g., pin, spike, pen, pencil, marker, etc.) and may be disposed at any location. The marking member may be secured to the marking section via any conventional or other securing mechanisms (e.g., threaded engagement, nut, welded, etc.). The height of the marking member may be adjusted via any conventional or other techniques (e.g., threaded engagement, etc.). The marking member may be constructed of any suitable materials (e.g., metal, plastic, etc.). The securing mechanism may be disposed at any location on the marking section and may be implemented by any conventional or other mechanism (e.g., thumbscrew, etc.) to secure the marking assembly position relative to the base.

The mounting mechanism for articles with single attachment points may be of any size or shape. The mechanism may include a handle of any size or shape, where a grip may be disposed at any desired location on the handle. The platform may be of any size or shape, and include any of the above-described marking devices. The hook may be of any quantity, size or shape, may be disposed at any location and may be implemented by any type of engagement mechanism (e.g., hook, bracket, picture hanger, etc.). The marking device may be disposed at any desired location relative to the hook to provide a mark at an appropriate location for a fastener. The mechanism may further include any quantity of level devices disposed at any suitable locations.

The measurement instrument may be of any size or shape and include any desired measurements (e.g., distance, angles, etc.). The instrument may include any quantity of any of the above described marking devices, where any quantity of devices may be fixed or in sliding relation to the instrument. The slot may be of any size or shape and disposed at any suitable location. The securing mechanism may be disposed at any location and may be implemented by any conventional or other securing mechanism (e.g., thumbscrew, etc.). The instrument may include any quantity of scales of any desired units (e.g., distance, angles, metric, British or Imperial system, etc.). The marking devices may be applied to any type of measuring device (e.g., ruler, compass, protractor, etc.). The instrument may include any quantity of any conventional or other level devices disposed at any suitable locations. The runner and indicators may be of any quantity, shape or size, may be constructed of any suitable materials and may be secured to the instrument in any fashion. The runner platform may be of any quantity, shape or size, where the marking device may be attached to the runner via any conventional or other securing techniques (e.g., brackets, welded, etc.). The runner may be implemented by any device providing a sliding relation with the instrument.

The level device may be of any quantity, shape or size and may be disposed at any suitable location on an article or support surface. The device may include any type of level (e.g., bubble, etc.) of any shape or size. The base may be of any shape or size and include any type of adhesive or sticky material to removably secure the level to an article or surface.

The marking devices described above may include any resilient member configurations described above and may be utilized to mark locations on a surface for any desired objects. An article may utilize any quantity of any of the above-described marking devices individually or in any combination. The resilient member may include any elasticity or resiliency, while the elasticity may be adjusted to accommodate any support surfaces or article configurations and weights. The adjustable or other locators may be utilized with any quantity of any secure and/or non-secure article mounting hardware to perform a security installation. The secure and/or non-secure mounting hardware may be used in any combination (e.g., only secure mounting hardware, only non-secure mounting hardware, a combination of secure and non-secure mounting hardware, etc.), where the hardware may be arranged on the article in any fashion.

It is to be understood that the terms "top", "bottom", "side", "front", "rear", "upper", "lower", "vertical", "horizontal", "height", "width", "length" and the like are used herein merely to describe points of reference and do not limit the present invention to any specific orientation or configuration.

From the foregoing description, it will be appreciated that the invention makes available a novel marking device and method for indicating locations on a support structure for fastener placement and measurement, wherein a marking device with a resilient member covering a marking member selectively indicates locations on a support surface or structure for measurement purposes or for placement of fasteners to suspend an article from that surface.

Having described preferred embodiments of a new and improved marking device and method for indicating locations on a support structure for fastener placement and measurement, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A marking apparatus to place a mark at a desired location on a support surface external of said marking apparatus comprising:

a base;

a resilient member having an aperture and being positioned within a perimeter of said base and responsive to forces received on an exterior surface of said resilient member to transition said resilient member from an expanded to a compressed state; and a marking member secured to said base to mark said support surface, wherein said marking member is recessed relative to said resilient member when said resilient member is in said expanded state and extends through said aperture and beyond said resilient member in said compressed state to mark said support surface at a location external of said marking device in response to said forces.

2. The marking apparatus of claim 1, wherein said marking member includes a spike to place a mark on said support surface.

3. The marking apparatus of claim 1, wherein said marking member includes a writing implement to place a mark on said support surface.

4. The marking apparatus of claim 1, wherein said marking member height is adjustable relative to said base.

5. The marking apparatus of claim 1, wherein said resilient member includes a covering to prevent placement of marks on said support surface in response to said resilient member contacting that surface.

6. The marking apparatus of claim 1, wherein said resilient member includes a resilient strip covering said marking member and including an aperture defined therein to enable said marking member to protrude through said resilient strip and mark said support surface in response to said forces.

7. The marking apparatus of claim 1, wherein said marking device is securable to a mounting mechanism fastened to an article to facilitate marking of fastener locations on said support surface to mount said article thereon, and said base includes an engagement mechanism to removably engage said mounting mechanism.

8. The marking apparatus of claim 7, wherein said marking member is displaced from said engagement mechanism.

9. The marking apparatus of claim 7, wherein said base further includes magnetic material to secure said base to said mounting mechanism.

10. The marking apparatus of claim 7, wherein said marking device is configured for a particular article mounting mechanism and for a particular support surface fastener.

11. The marking apparatus of claim 7, further including:

a level device to indicate said article orientation relative to said support surface and including:

a level base including an adhesive disposed on a level base surface to removably secure said level device to said article; and a level disposed on said level base to indicate said article orientation.

12. A method of placing a mark on a support surface at a desired location comprising:

a) positioning a marking device adjacent said support surface at said desired location, wherein said support surface is external of said marking device, and wherein said marking device includes a resilient member having an aperture and being positioned within a perimeter of said marking device, said marking device being responsive to forces received on an exterior surface thereof from said external support surface to transition from an expanded to a compressed state and a marking member recessed relative to said resilient member when said resilient member is in said expanded state; and (b) applying force to said marking device to force said resilient member against said support surface and into a compressed state and enable said marking member to extend through said aperture and beyond said compressed resilient member and mark said support surface at a location external to said marking device.

13. The method of claim 12, wherein said marking member includes a spike and step (b) further includes:

(b.1) placing a mark on said support surface with said spike in response to said applied force.

14. The method of claim 12, wherein said marking member includes a writing implement and step (b) further includes:

(b.1) placing a mark on said support surface with said writing implement in response to said applied force.

15. The method of claim 12, wherein step (a) further includes:

(a.1) placing a covering on said resilient member to prevent placement of marks on said support surface during said positioning of said marking device.

16. The method of claim 12, wherein step (a) further includes:

(a.1) removably securing said marking device to a mounting mechanism fastened to an article to facilitate marking of fastener locations on said support surface to mount said article thereon; and step (b) further includes:

(b.1) applying force to said article to compress said resilient member and enable said marking member to extend beyond said compressed resilient member and mark said support surface.

17. The method of claim 16, wherein said marking member is displaced from said mounting mechanism.

18. The method of claim 16, wherein said marking device is configured for a particular article mounting mechanism and for a particular support surface fastener.

19. The method of claim 16, wherein step (a) further includes:

(a.2) removably securing a level device to said article to indicate said article orientation relative to said support surface, wherein said level device includes a level base including an adhesive disposed on a level base surface to removably secure said level device to said article and a level disposed on said level base to indicate said article orientation; and (a.3) adjusting article orientation in accordance with said level indication.

20. A marking apparatus to place a mark at a desired location on a support surface external of said marking apparatus comprising:

an article support mechanism;

a base to accept said article support mechanism;

a resilient member secured to said base and responsive to forces received on an exterior surface of said resilient member to transition said resilient member from an expanded to a compressed state; and a marking member secured to said base to mark said support surface, wherein said marking member is recessed relative to said resilient member when said resilient member is in said expanded state and extends beyond said resilient member in said compressed state to mark said support surface at a location external of said marking device in response to said forces.

* * * * *

UNITED STATES PATENT AND TRADEMARK OFFICE

CERTIFICATE OF CORRECTION

PATENT NO. : 6,952,887 B2
DATED : October 11, 2005
INVENTOR(S) : Boris A. Muchnik It is certified that error appears in the above-identified patent and that said Letters Patent is hereby corrected as shown below:

Column 30,
Line 51, delete claims 7-20 and replace with the following:

--7. The marking apparatus of claim 6, wherein said resilient strip includes overlapped portions to cover said marking member.
8. The marking apparatus of claim 1, wherein said resilient member includes a ring encompassing said marking member, wherein said ring is constructed of a resilient material.
9. The marking apparatus of claim 1, wherein said resilient member includes:
a housing; and
bias member disposed within said housing and encompassing said marking member, wherein said bias member transitions between said states to enable said marking member to mark said support surface in response to said forces.
10. The marking apparatus of claim 1, wherein said resilient member includes:
bias mechanism encompassing said marking member, wherein said bias mechanism transitions between said states to enable said marking member to mark said support surface in response to said forces.
11. The marking apparatus of claim 1 further including: an audio indicator to provide an audio indication in response to placement of said mark on said support surface.
12. The marking apparatus of claim 1 further including: a switching device connected to at least one of an audio indicator and a visual indicator to actuate said at least one indicator in response to placement of said mark on said support surface.
13. The marking apparatus of claim 1, wherein said marking device is securable to a mounting mechanism fastened to an article to facilitate marking of fastener locations on said support surface to mount said article thereon, and said base includes an engagement mechanism to removably engage said mounting mechanism.
14. The marking apparatus of claim 13, wherein said marking member is displaced from said engagement mechanism.
15. The marking apparatus of claim 13, wherein said base further includes magnetic material to secure said base to said mounting mechanism.

16. The marking apparatus of claim 13, wherein said resilient member includes a plurality of projections extending from edges of said base and forming an open area proximate said marking member to enable said marking member to extend beyond said projections and mark said support surface in response to said forces.
17. The marking apparatus of claim 13, wherein said marking device is configured for a particular article mounting mechanism and for a particular support surface fastener.
18. The marking apparatus of claim 13, wherein said marking device further includes:
a marking assembly including said resilient member and said marking member, wherein said marking assembly slidably engages said base to enable adjustment of marking device dimensions to accommodate said mounting mechanism.
19. The marking apparatus of claim 18, wherein said base includes a groove defined therein to receive fasteners securing said mounting mechanism to said article.
20. The marking apparatus of claim 19, wherein said engagement mechanism includes at least one magnet to removably secure said base to said mounting mechanism.
21. The marking apparatus of claim 18, wherein said marking device further includes gripping material to engage at least one of said mounting mechanism and article.
22. The marking apparatus of claim 18, wherein said marking assembly further includes a projection to engage said mounting mechanism to align said marking member with said mounting mechanism.
23. The marking apparatus of claim 1 further including:
a handle;
a platform connected to said handle and including said marking device secured thereto; and
an article engagement member to receive an article mounting mechanism to suspend said article therefrom.
24. The marking apparatus of claim 23 further including: a level device to indicate said article orientation relative to said support surface.

UNITED STATES PATENT AND TRADEMARK OFFICE

CERTIFICATE OF CORRECTION

PATENT NO. : 6,952,887 B2
DATED : October 11, 2005
INVENTOR(S) : Boris A. Muchnik It is certified that error appears in the above-identified patent and that said Letters Patent is hereby corrected as shown below:

Column 30 (cont'd),

25. The marking apparatus of claim 13, further including:
a level device to indicate said article orientation relative to said support surface and including:
a level base including an adhesive disposed on a level base surface to removably secure said level device to said article; and
a level disposed on said level base to indicate said article orientation.
26. The marking apparatus of claim 1 further including:
a measuring member including at least one scale providing measurements thereon; and
a plurality of said marking devices, wherein at least one of said marking devices is fixedly secured to said measuring member to place a mark on said support surface indicating a reference position, and wherein at least one other of said marking devices is secured to said measuring member in slidable relation relative to said at least one scale to place a mark on said support surface indicating a desired measurement with respect to said reference position mark.
27. A method of placing a mark on a support surface at a desired location comprising:
a) positioning a marking device adjacent said support surface at said desired location, wherein said support surface is external of said marking device, and wherein said marking device includes a resilient member having an aperture and being positioned within a perimeter of said marking device, said marking device being responsive to forces received on an exterior surface thereof from said external support surface to transition from an expanded to a compressed state and a marking member recessed relative to said resilient member when said resilient member is in said expanded state; and
(b) applying force to said marking device to force said resilient member against said support surface and into a compressed state and enable said marking member to extend through said aperture and beyond said compressed resilient member and mark said support surface at a location external to said marking device.
28. The method of claim 27, wherein said marking member includes a spike and step (b) further includes:
(b.1) placing a mark on said support surface with said spike in response to said applied force.

29. The method of claim 27, wherein said marking member includes a writing implement and step (b) further includes:
(b.1) placing a mark on said support surface with said writing implement in response to said applied force.
30. The method of claim 27, wherein step (a) further includes:
(a.1) placing a covering on said resilient member to prevent placement of marks on said support surface during said positioning of said marking device.
31. The method of claim 27 further including:
(c) providing an audio indication in response to placement of said mark on said support surface.
32. The method of claim 27, wherein said marking device includes a switching device connected to at least one of an audio indicator and a visual indicator, and said method further includes:
(c) actuating said switching device to provide said at least one audio and visual indication in response to placement of said mark on said support surface.
33. The method of claim 27, wherein step (a) further includes:
(a.1) removably securing said marking device to a mounting mechanism fastened to an article to facilitate marking of fastener locations on said support surface to mount said article thereon; and
step (b) further includes:
(b.1) applying force to said article to compress said resilient member and enable said marking member to extend beyond said compressed resilient member and mark said support surface.
34. The method of claim 33, wherein said marking member is displaced from said mounting mechanism.
35. The method of claim 33, wherein said marking device is configured for a particular article mounting mechanism and for a particular support surface fastener.
36. The method of claim 33, wherein said marking device further includes a marking assembly including said resilient member and said marking member, and wherein said marking assembly slidably engages a base, and step (a) further includes:
(a.1) adjusting marking device dimensions to accommodate said mounting mechanism.

UNITED STATES PATENT AND TRADEMARK OFFICE

CERTIFICATE OF CORRECTION

PATENT NO. : 6,952,887 B2
DATED : October 11, 2005
INVENTOR(S) : Boris A. Muchnik It is certified that error appears in the above-identified patent and that said Letters Patent is hereby corrected as shown below:

Column 30 (cont'd),

37. The method of claim 36, wherein said marking assembly further includes a projection, and step (a) further includes:
(a.2) engaging said mounting mechanism with said projection to align said marking member with said mounting mechanism.
38. The method of claim 27, wherein said marking device includes a handle and an article engagement member, and step (a) further includes:
(a.1) receiving an article mounting mechanism within said article engagement member to suspend said article therefrom and positioning said marking device with said article adjacent said support surface at said desired location.
39. The method of claim 33, wherein step (a) further includes:
(a.2) removably securing a level device to said article to indicate said article orientation relative to said support surface, wherein said level device includes a level base including an adhesive disposed on a level base surface to removably secure said level device to said article and a level disposed on said level base to indicate said article orientation; and
(a.3) adjusting article orientation in accordance with said level indication.
40. The method of claim 27, wherein step (a) further includes:
(a.1) positioning a measuring device adjacent said support surface at said desired location, wherein said measuring device includes a measuring member including at least one scale providing measurements thereon and a plurality of said marking devices with at least one of said marking devices fixedly secured to said measuring member and at least one other of said marking devices in slidable relation relative to said at least one scale; and
(a.2) positioning said at least one slidable marking device at a location indicating a desired measurement; and
step (b) further includes:
(b.1) applying force to said measuring device to place marks on said support surface indicating a reference position and a desired measurement with respect to said reference position mark.

UNITED STATES PATENT AND TRADEMARK OFFICE

CERTIFICATE OF CORRECTION

PATENT NO. : 6,952,887 B2
DATED : October 11, 2005
INVENTOR(S) : Boris A. Muchnik It is certified that error appears in the above-identified patent and that said Letters Patent is hereby corrected as shown below:

Column 30 (cont'd),

41. The marking apparatus of claim 13, wherein said marking device is predisposed on said article mounting mechanism.
42. The marking apparatus of claim 18, wherein said article includes at least one security mounting mechanism to facilitate secure mounting of said article on said support surface.
43. The method of claim 27, wherein step (a) further includes: (a.1) predisposing said marking device on a mounting mechanism fastened to an article to facilitate marking of fastener locations on said support surface to mount said article thereon; and
step (b) further includes:
(b.1) applying force to said article to compress said resilient member and enable said marking member to extend beyond said compressed resilient member and mark said support surface.
44. The method of claim 36, wherein said article includes at least one security mounting mechanism to facilitate secure mounting of said article on said support surface.
45. A marking apparatus to place a mark at a desired location on a support surface external of said marking apparatus comprising:
an article support mechanism;
a base to accept said article support mechanism;
a resilient member secured to said base and responsive to forces received on an exterior surface of said resilient member to transition said resilient member from an expanded to a compressed state; and
a marking member secured to said base to mark said support surface, wherein said marking member is recessed relative to said resilient member when said resilient member is in said expanded state and extends beyond said resilient member in said compressed state to mark said support surface at a location external of said marking device in response to said forces.--

Signed and Sealed this

Seventh Day of February, 2006

JON W. DUDAS
*Director of the United States Patent and Trademark Office*